US010143931B2

(12) United States Patent
Wang et al.

(10) Patent No.: US 10,143,931 B2
(45) Date of Patent: Dec. 4, 2018

(54) TOY CONSTRUCTION SET

(71) Applicant: Shenzhen Bell Creative Science and Education Co., Ltd., Shenzhen (CN)

(72) Inventors: Zuobing Wang, Shenzhen (CN); Zhiguang Dai, Shenzhen (CN)

(73) Assignee: Shenzhen Bell Creative Science and Education Co., Ltd., Shenzhen (CN)

( * ) Notice: Subject to any disclaimer, the term of this patent is extended or adjusted under 35 U.S.C. 154(b) by 0 days.

(21) Appl. No.: 15/863,260

(22) Filed: Jan. 5, 2018

(65) Prior Publication Data

US 2018/0264373 A1 Sep. 20, 2018

Related U.S. Application Data

(63) Continuation of application No. PCT/CN2017/077250, filed on Mar. 20, 2017.

(51) Int. Cl.
*A63H 33/04* (2006.01)
*A63H 33/10* (2006.01)

(52) U.S. Cl.
CPC ..... *A63H 33/042* (2013.01); *A63H 33/105* (2013.01); *A63H 33/107* (2013.01)

(58) Field of Classification Search
CPC ... A63H 33/042; A63H 33/107; A63H 33/105
USPC ... 446/90, 91, 103, 104, 105, 106, 107, 108, 446/109
See application file for complete search history.

(56) References Cited

U.S. PATENT DOCUMENTS 1,985,032 A * 12/1934 Hoult ..... A63H 33/12 446/121
3,811,218 A * 5/1974 Salmon ..... A63H 17/002 446/94
D315,182 S * 3/1991 Olsen ..... D21/502
(Continued)

FOREIGN PATENT DOCUMENTS

CN 101310810 A 11/2008
CN 103961888 A 8/2014
KR 20110032831 A 3/2011

OTHER PUBLICATIONS

International Search Report and Written Opinion of the International Searching Authority directed to related International Patent Application No. PCT/CN2017/077250, dated Dec. 21, 2017; 12 pages.

*Primary Examiner* — Vishu Mendiratta
(74) *Attorney, Agent, or Firm* — Bayes PLLC

(57) ABSTRACT

A toy construction set includes first and second construction elements, a pin, and a fastener including a body and a head. Each of the first and second construction elements includes through-holes and grooves on two major surfaces, respectively, of the construction element. A thickness of each groove is substantially the same. At at least one end of each groove, an edge of the groove is curved. The pin includes a body having a cavity and a member. A first portion of an edge of the member is curved, and a second portion of the edge of the member is straight. A thickness of the member is not larger than the thickness of each groove. The member of the pin is fixed in place in one of the grooves of the first construction element when the first and second construction elements are coupled by the pin and the fastener so as to constrain the pin from rotating with respect to an axis of the body of the pin.

22 Claims, 32 Drawing Sheets

(56) References Cited

U.S. PATENT DOCUMENTS

| | | | | | |
|---|---|---|---|---|---|
| 5,049,104 | A * | 9/1991 | Olsen | A63H 33/042 | 403/156 |
| 5,071,384 | A * | 12/1991 | Poulsen | A63H 17/36 | 446/103 |
| D516,135 | S * | 2/2006 | Kim | D21/503 | |
| 7,736,211 | B2 * | 6/2010 | Marzetta | A63H 33/106 | 446/113 |
| 2007/0277459 | A1 | 12/2007 | Marzetta | | |
| 2014/0241791 | A1 | 8/2014 | Kim | | |

* cited by examiner

302

304

306

3400

PLAN VIEW

PERSPECTIVE VIEW

SIDE VIEW

3500

PLAN VIEW

PERSPECTIVE VIEW

SIDE VIEW

TOY CONSTRUCTION SET

CROSS REFERENCE TO RELATED APPLICATION

This application is continuation of International application Ser. No. PCT/CN2017/077250, filed on Mar. 20, 2017, entitled "Toy Construction Set," which is hereby incorporated by reference in its entirety.

BACKGROUND

The disclosure relates generally to toys, and more particularly, to toy construction sets.

Toys built by multiple intercornectable parts have been used for entertainment, educational, architectural, design, research, and development purposes. For example, LEGO® is a line of plastic construction toys including different types of parts that can be interconnected in various ways to build different objects, such as vehicles, buildings, and human characters. In order to assemble and disassemble parts of the toy construction set, a friction-fit mechanism is used by LEGO® by simply applying force to the plastic parts.

However, known toy construction sets, such as LEGO®, have encountered issues such as limited structural integrity and range of motion due to the use of plastic parts and friction-fit mechanism.

SUMMARY

In one example, a toy construction set includes first and second construction elements, a pin, and a fastener. Each of the first and second construction elements includes a plurality of through-holes and at least two grooves on two major surfaces, respectively, of the construction element along an axis of at least one of the through-holes. A depth of each groove is substantially the same. At at least one end of each groove, an edge of the groove is curved. The pin includes a body having a cavity and a member attached to one end of the body. A first portion of an edge of the member is curved and a second portion of the edge of the member is straight. A thickness of the member is not larger than the depth of each groove. The fastener includes a body and a head. The pin and the fastener are configured to couple the first and second construction elements such that the body of the pin is configured to pass through an entirety of a first through-hole in the first construction element and at least a portion of a second through-hole in the second construction element and the body of the fastener is configured to insert into the cavity of the pin. The member of the pin is fixed in place in one of the grooves of the first construction element when the first and second construction elements are coupled by the pin and the fastener so as to constrain the pin from rotating with respect to an axis of the body of the pin.

In another example, a toy construction set includes a connector, first and second pins, first and second fasteners each including a body and a head, and first and second construction elements each including a through-hole. The connector includes a first portion having a first through-hole and a second portion having a second through-hole. An axis of the first through-hole in the first portion is perpendicular to an axis of the second through-hole in the second portion. Each of the first and second portions includes two grooves on two major surfaces, respectively, of the respective portion of the connector along an axis of the first or second through-hole in the respective portion. Each of the first and second pins includes a body having a cavity and a member attached to one end of the body. A thickness of the member is not larger than a depth of each groove. The first pin and the first fastener are configured to couple the connector and the first construction element such that the body of the first pin is configured to pass through at least a portion of the first through-hole in the first potion of the connector and at least a portion of the through-hole in the first construction element and the body of the first fastener is configured to insert into the cavity in the first pin. The second pin and the second fastener are configured to couple the connector and the second construction element such that the body of the second pin is configured to pass through at least a portion of the second through-hole in the second potion of the connector and at least a portion of the through-hole in the second construction element and the body of the second fastener is configured to insert into the cavity in the second pin. The first and second construction elements are coupled via the connector so that an axis of the through-hole in the first construction element is perpendicular to an axis of the through-hole in the second construction element.

In still another example, a toy construction set includes first and second construction elements, a base pin, at least one connection pin each including a body having a cavity and a bolt, and a fastener including a body and a head. Each of the first and second construction elements includes a plurality of through-holes and at least two grooves on two major surfaces, respectively, of the construction element along an axis of at least one of the through-holes. A depth of each groove is substantially the same. At at least one end of each groove, an edge of the groove is curved. The base pin includes a body having a cavity and a member attached to one end of the body. T first portion of an edge of the member is curved and a second portion of the edge of the member is straight. A thickness of the member is not larger than the depth of each groove. The base pin, the at least one connection pin, and the fastener are configured to couple the first and second construction elements such that the body of the base pin is configured to pass through at least a portion of a first through-hole in the first construction element and the body of the fastener is configured to insert into the cavity of one of the at least one connection pin and inserting the bolt of one of the at least one connection pin into the cavity of the base pin. The member of the base pin is fixed in place in one of the grooves of the first construction element when the first and second construction elements are coupled by the base pin, the at least one connection pin, and the fastener so as to constrain the base pin from rotating with respect to an axis of the body of the base pin. The first and second construction elements are spaced apart by the at least one connection pin.

BRIEF DESCRIPTION OF THE DRAWINGS

The embodiments will be more readily understood in view of the following description when accompanied by the below figures and wherein like reference numerals represent like elements, wherein.

DETAILED DESCRIPTION

Figure 1:
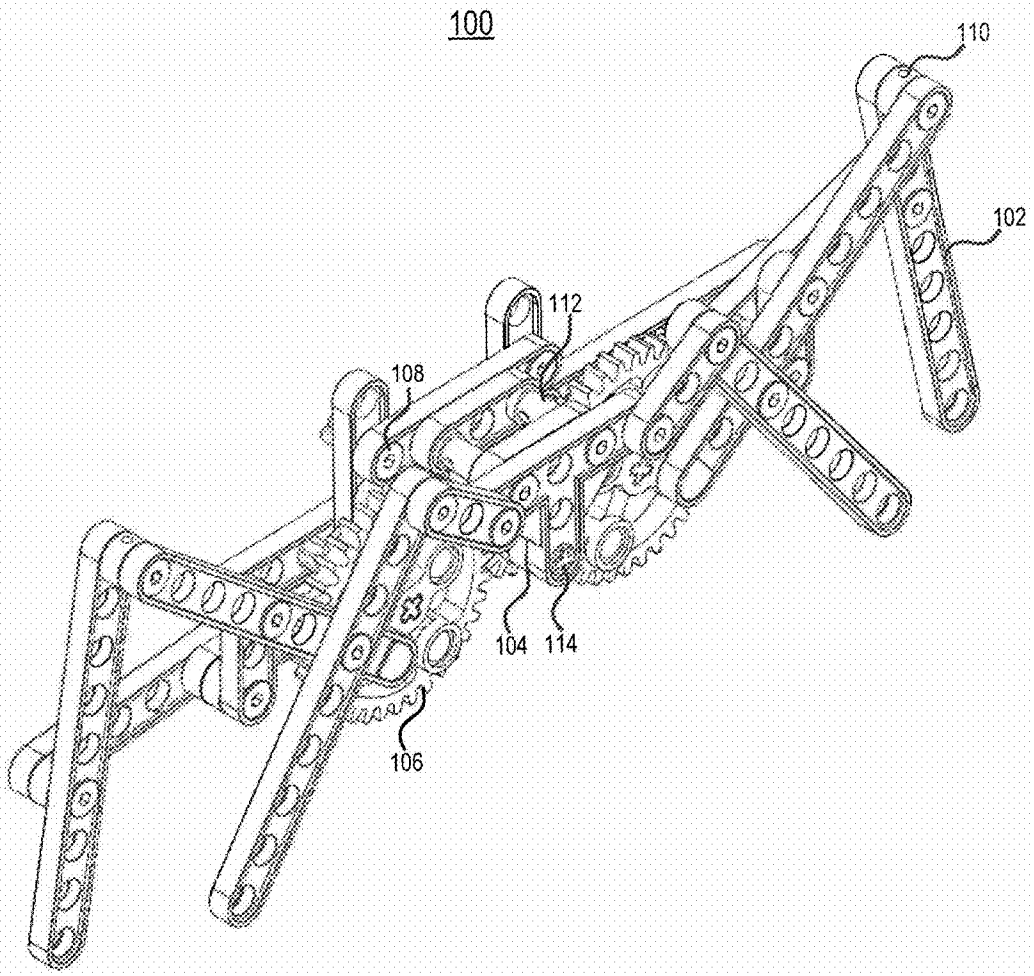
FIG. 1 is a perspective view of an example of a toy built by a toy construction set in accordance with an embodiment.

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Toy Construction Sets

As will be disclosed in detail below, among other novel features, the toy construction sets disclosed herein provide the ability to easily and quickly assemble and disassemble a wide variety of toy structures by hand with great structural integrity. In some embodiments, fastening elements in the toy construction sets can provide strong and resilient connections between jointed construction elements, while maintaining the desired range of motion as needed. In some embodiments, connectors in the toy construction sets can provide spatial expansibility to build a large number of toy structures, while saving the space of the toy structures. In some embodiments, the toy construction sets include a wide variety of construction elements for different purposes with standardized designs suitable for the fastening elements, connectors, and interconnection mechanisms. In some embodiments, parts of the toy construction sets can be made from a metal material, which has the better structural strength, wear resistance, heat resistance, etc., compared to other materials, such as plastic.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

The toy construction sets disclosed herein include various types of parts including, for example, construction elements, connectors, and fastening elements. As described below in detail, construction elements may include basic construction elements, such as different types of beams, used to define structures, and auxiliary construction elements used to provide functions to the assembled toy structures, such as gears, racks, worms, pulleys, turntables, wheels, chains, and track that are used to induce or facilitate motion. Connectors may include orthogonal connectors and three-dimensional (3D) connectors used to interconnect construction elements and/or other connectors in various directions and planes. Fastening elements may include various types of pins, fasteners, washers, and shafts used to couple construction elements and/or connectors together in various manners. It is to be appreciated that some parts may serve more than one purpose and that reference herein to a part as a construction element, a connector, or a fastening element should not be taken in a limiting sense.

The particular size and shape of the various parts of the toy construction sets disclosed herein may vary from one embodiment to another embodiment without departing from the spirit or scope of the present disclosure. Therefore, while dimensions, proportions, and other physical characters of various parts are set forth herein, it is to be appreciated that such information is provided by way of examples and does not limit the scope of the present disclosure.

FIG. 1 is a perspective view of an example of a toy 100 built by a toy construction set in accordance with an embodiment. In this example, toy 100 is assembled by basic construction elements, including straight beams 102 and shaped beams 104, and auxiliary construction elements including gears 106. The construction elements are coupled together by fastening elements including fixation base pins 108, loose base pins 110, connection pins 112, cross shafts 114, and fasteners and washers (not shown). In this embodiment, straight beams 102 and shaped beams 104 are basic structural elements that define the basic structure of toy 100.

Gears 106 provide functions to toy 100, such as rotation of the beams. The various types and combinations of fastening elements provide different coupling mechanisms to different jointed parts, such as fixation of two beams by fixation base pins 108 in conjunction with fasteners and washers and rotatable joint of two beams by loose base pins 110 in conjunction with fasteners. In some embodiments, the parts of toy 100 may be made from a metal material (including metal alloy materials), such as but not limited to, aluminum alloy, stainless steel, copper alloy, aluminum, copper, tin, iron, nickel, etc. In some embodiments, the parts of toy 100 may be made from other materials, for example, carbon fiber, high-strength nylon, to name a few. As shown in FIG. 1 and described below in detail, the design of the fastening elements and the coupling mechanisms, as well as the design of the construction elements and connectors (not shown) that is adapted to receive the fastening elements, can ensure that the parts of toy 100 have strong and resilient connections yet can be easily and quickly assembled and disassembled by users, including children. Also, as shown in FIG. 1, there is no external space that is needed for the fastening elements in toy 100.

Basic Construction Elements

The basic construction elements in the toy construction sets disclosed herein are the basic parts of the toy construction sets used for defining the structures of toys, such as the frames. In some embodiments, the basic construction elements include various types of beams, such as straight beams, shaped beams, and cross-hole beams. As described below in detail, these beams share some similar properties: each including a plurality of through-holes and at least two grooves on two major surfaces, respectively, of the beam along an axis of at least one of the through-holes; at at least one end of each groove, an edge of the groove is curved; the depth of each groove is substantially the same. Each beam, however, may have a different number of through-holes (e.g., 2, 3, 5, 7, 9, 11, 13, 15, etc.), and the through-holes may have different shapes in the plan view (e.g., round, stadium, cross, etc.). The overall shape of each beam in the plan view may be different as well (e.g., stadium shape, "I" shape, "L" shape, etc.). In some embodiments, the basic construction elements may be made from a metal material (including metal alloy materials), such as hut not limited to, aluminum alloy, stainless steel, copper alloy, aluminum, copper, tin, iron, nickel, etc.

Figure 2A:
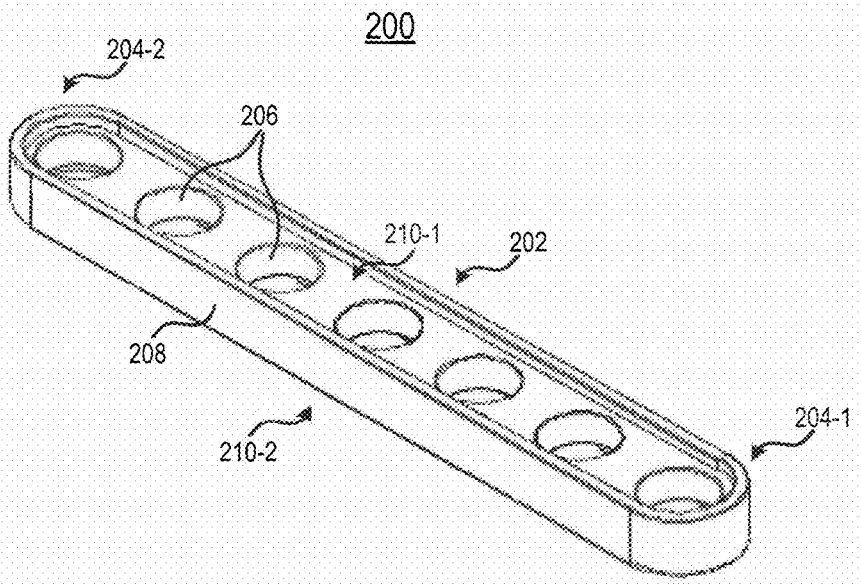
FIG. 2A is a perspective view of an example of a straight beam in a toy construction set in accordance with an embodiment.

FIG. 2A is a perspective view of an example of a straight beam 200 in a toy construction set in accordance with an embodiment. Straight beam 200 is one of the basic construction elements of the toy construction sets and may be provided in various lengths as illustrated below in FIGS. 3A-3C. As shown in FIG. 2A, straight beam 200 includes a body 202 having two ends 204-1 and 204-2. A plurality of through-holes 206 arranged in a straight line are formed in straight beam 200. Straight beam 200 also includes a wall 208 that surrounds the entire edge of straight beam 200. Two grooves 210-1 and 210-2 are formed on the two major surfaces of straight beam 200, respectively, along an axis of through-holes 206. In other words, each groove 210 is defined by wall 208 and the respective major surface of straight beam 200. In this embodiment, at each end 204 of straight beam 200, an edge of groove 210 is curved. For example, the degree of curvature of the edge of each groove 210 may be substantially the same as that of through-hole 206 at end 204, i.e., a semicircle. It is to be appreciated that in some embodiments, the edge of each groove 210 may be curved at only one end 204 and may be straight at the other end 204.

Figure 2B:
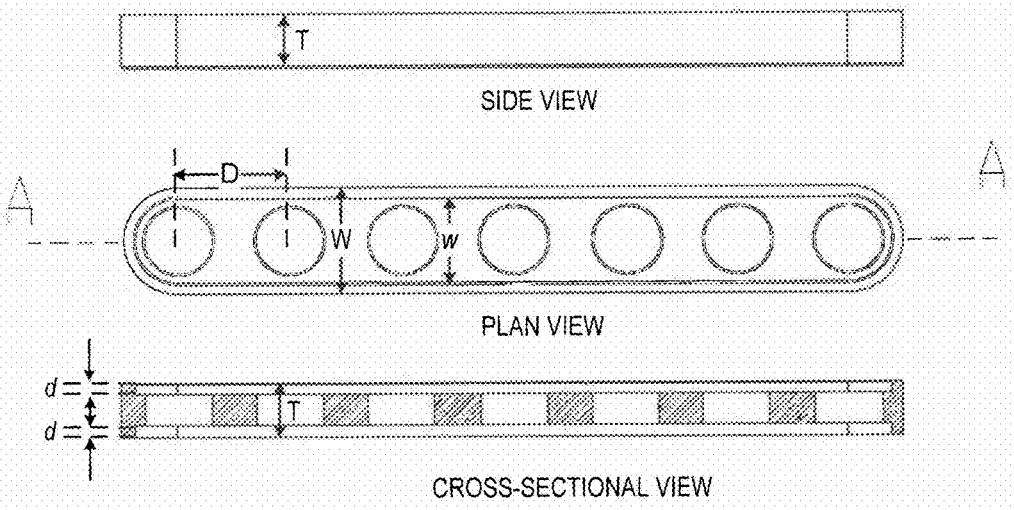
FIG. 2B depicts a side view, a plan view, and a cross-sectional view of the straight beam in FIG. 2A in accordance with an embodiment.

FIG. 2B depicts a side view, a plan view, and a cross-sectional view of straight beam 200 in FIG. 2A in accordance with an embodiment. As shown in the side view, straight beam 200 has a thickness T, which is also the height of wall 208. In this embodiment, wall 208 has a uniform height and thus, the thickness T is also uniform for straight beam 200. In some embodiments, the thickness T is 4 millimeter (mm).

As shown in the plan view of FIG. 2B, the number of through-holes 206 is seven in this embodiment, and each through-hole 206 is a round hole. It is to be appreciated that in some embodiments, one or more through-holes 206 may not be a round hole, but instead, may be a cross hole, a square hole, etc. In this embodiment, the distance D between a center of each through-hole 206 is substantially the same, so is the diameter of each through-hole 206. In some embodiments, the diameter of each through-hole 206 is 4.8 mm, and the distance D is 8 mm. Straight beam 200 in this embodiment may be named as "7-hole straight beam." The length of straight beam 200 then may be determined based on the number of through-holes 206. As shown in the plan view, straight beam 200 has a width W, which is measured between the two opposing outer edges of wall 208 along the width direction. Each groove 210 of straight beam 200 also has a width w, which is measured between two opposing inner edges of wall 208 along the width direction. That is, the width w of groove 210 plus twice that of the thickness of wall 208 equals to the width W of straight beam 200. In some embodiments, the width W of straight beam 200 is 8 mm, the width w of each groove 210 is 6.1 mm, and the thickness of wall 208 is 0.95 mm.

As shown in the cross-section view of FIG. 2B, which is along the line A-A of the plan view, each groove 210 has the depth d. The thickness T of straight beam 200 equals to twice that of the depth d of groove 210 plus the depth of through-hole 206. In some embodiments, the depth d of groove 210 is 0.8 mm, the thickness T of straight beam 200 is 4 mm, and the depth of through-hole 206 is 2.4 mm.

Figure 3A:
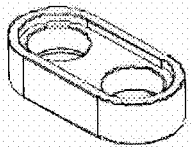
FIGS. 3A-3C are perspective views of examples of straight beams in a toy construction set in accordance with various embodiments.
Figure 3B:
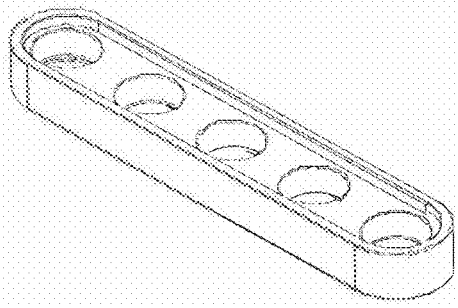
Figure 3C:
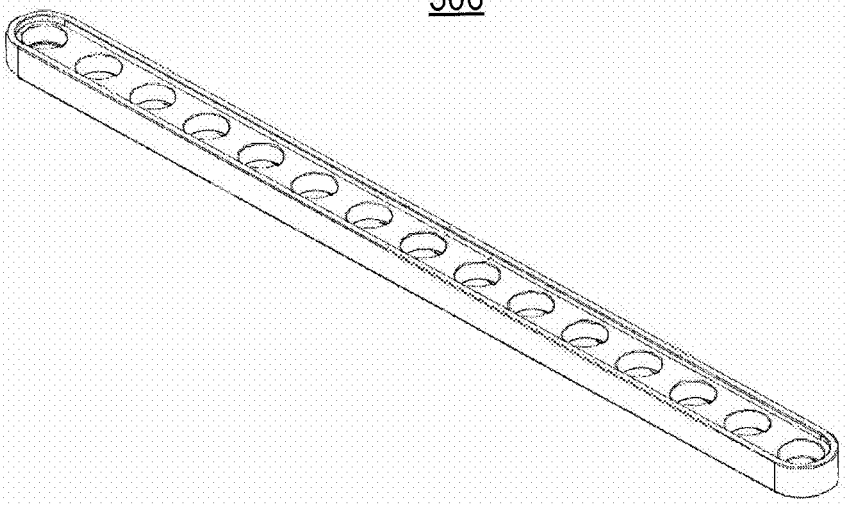

FIGS. 3A-3C are perspective views of examples of straight beams in a toy construction set in accordance with various embodiments. As described above, the length of a straight beam is not limited. In addition to 7-hole straight beam 200 shown in FIGS. 2A-2B, a 2-hole straight beam 302, a 5-hole straight beam 304, and a 15-hole straight beam 306 are shown in FIGS. 3A-3C, respectively, as examples of straight beams with different lengths (number of through-holes therein). In some embodiments, as the distance d between the center of each through-hole is substantially the same, e.g., 8 mm, the length of the example straight beams in FIGS. 3A-3C may be determined based on the number of through-holes in the straight beam. Besides the length (number of through-holes therein), other dimensions and shape of the example straight beams in FIGS. 3A-3C are substantially the same as those of straight beam 200 in FIGS. 2A-2B. A straight beam can be used as the basic structural element of the toy construction sets to define the basic structure of a toy, e.g., frames, and the straight beams with different lengths can be used for structures with different dimensions and/or shapes.

Figure 4A:
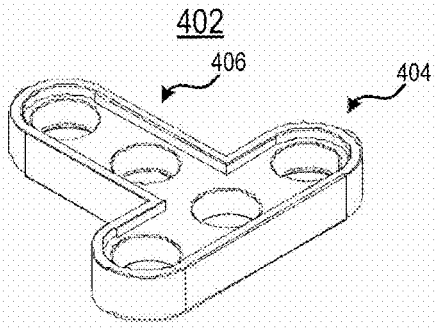
FIGS. 4A-4E are perspective views of examples of shaped beams in a toy construction set in accordance with various embodiments.
Figure 4B:
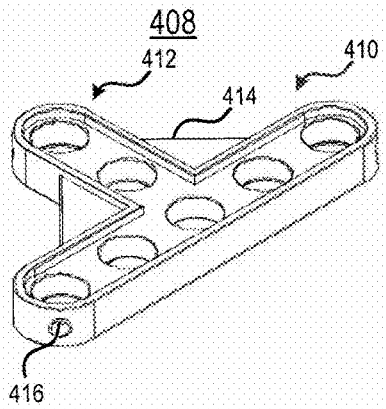

FIGS. 4A-4E are perspective views of examples of shaped beams in a toy construction set in accordance with various embodiments. As shown in FIGS. 2A-2B and 3A-3C, a straight beam includes a body having two ends thereof. A shaped beam, however, includes at least two bodies having at least three ends thereof. In other words, the overall shape (in the plan view) of a shaped beam is not a stadium shape as a straight beam. Also, as a shaped beam includes more than two bodies, the through-holes in a shaped beam may be arranged in multiple lines (e.g., in the multiple bodies). As shown in FIG. 4A, a shaped beam 402 includes a first body 404 and a second body 406 that is extended from the middle of first body 404 and is perpendicular to first body 404. That is, shaped beam 402 has a "T" shape (in the plan view) in general. First body 404 has two ends, and second body 406 has a third end of shaped beam 402. Similar to the example straight beams illustrated above, shaped beam 402 has two grooves on the two major surfaces, respectively, along an axis of the through-holes. At each of the three ends of shaped beam 402, an edge of each groove is curved. The depth of each groove of shaped beam 402 is substantially the same. As shown in FIG. 4B, a shaped beam 408 includes a first body 410, a second body 412 that is extended from the middle of first body 410 and is perpendicular to first body 410. Different from shaped beam 402, shaped beam 408 also includes two reinforcement members 414. Reinforcement members 414 may be used to provide additional structural support to first and second bodies 410 and 412. In this embodiment, a screw hole 416 is provided through the wall of shaped beam 408 to a through-hole at one end of first body 410. Screw hole 416 is about 45 degrees from the length direction of first body 410 and may be configured to receive a screw for further securing any part inside the respective through-hole, e.g., a pin or a cross shaft.

Figure 4C:
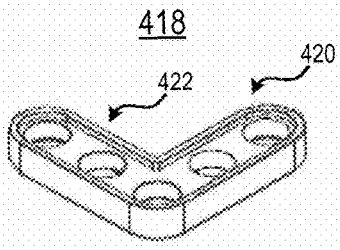
Figure 4D:
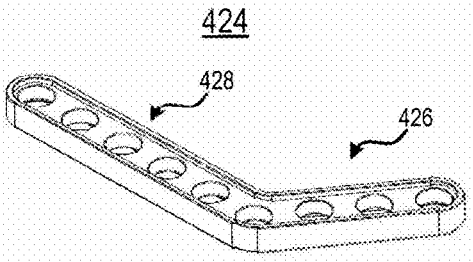

As shown in FIG. 4C, a shaped beam 418 includes a first body 420 and a second body 422 that is extended from one end of first body 420 and is perpendicular to first body 420. That is, shaped beam 418 has an "L" shape (in the plan view) in general. Each of first and second bodies 420 and 422 has one end, and first and second bodies 420 and 422 also share the third end of shaped beam 418. As shown in FIG. 4D, a shaped beam 424 includes a first body 426 and a second body 428 that is extended from one end of first body 426 at an obtuse angle. In some embodiments, the angle between first and second bodies 426 and 428 is about 126.87 degrees. Thus, shaped beam 424 can be used to build frame structures that follow the Pythagorean theorem.

Figure 4E:
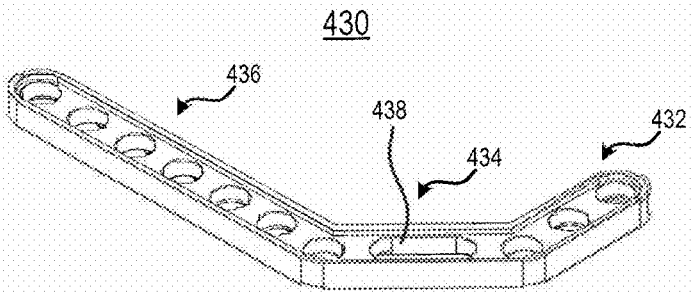

As shown in FIG. 4E, a shaped beam 430 includes a first body 432, a second body 434 that is extended from one end of first body 432 at the 135-degree angle, and a third body 436 that is extended from one end of second body 434 at the 135-degree angle. That is, first and third bodies 432 and 436 are perpendicular to one another. In this embodiment, each of first and third bodies 432 and 436 has one end and also shares another end with second body 434, respectively. In the example shaped beams described in FIGS. 4A-4D, each through-hole is a round hole. In FIG. 4E, each through-hole in first and third bodies 432 and 436 is a round hole, while through-hole 438 in second body 434 has a substantially rectangular shape (in the plan view) with two curved ends (i.e., a "stadium" shape). It is to be appreciated that, unless explicitly described and/or illustrated otherwise, each shaped beam in FIGS. 4A-4E may share the same properties, e.g., the material of the beams and the dimensions and shape of the grooves and through-holes, as the example straight beam 200 described in FIGS. 2A-2B. For example, each shaped beam in FIGS. 4A-4E may have at least two grooves on two major surfaces, respectively, of the shaped beam along an axis of at least one through-hole, and the depth of each groove may be substantially the same. It is also to be appreciated that the sizes of the shaped beams are not limited to the example shaped beams in FIGS. 4A-4E. For example, the length (the number of through-holes) in each body of a shaped beam may vary in different examples.

Figure 5A:
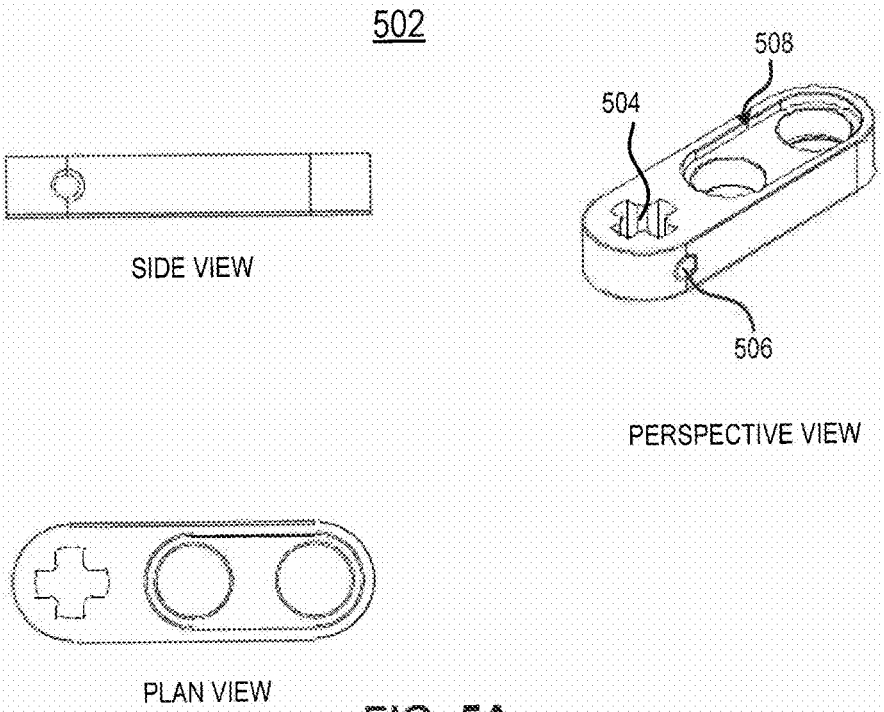
FIG. 5A depicts a perspective view, a side view, and a plan view of an example of a cross-hole beam in a toy construction set in accordance with an embodiment.
Figure 5B:
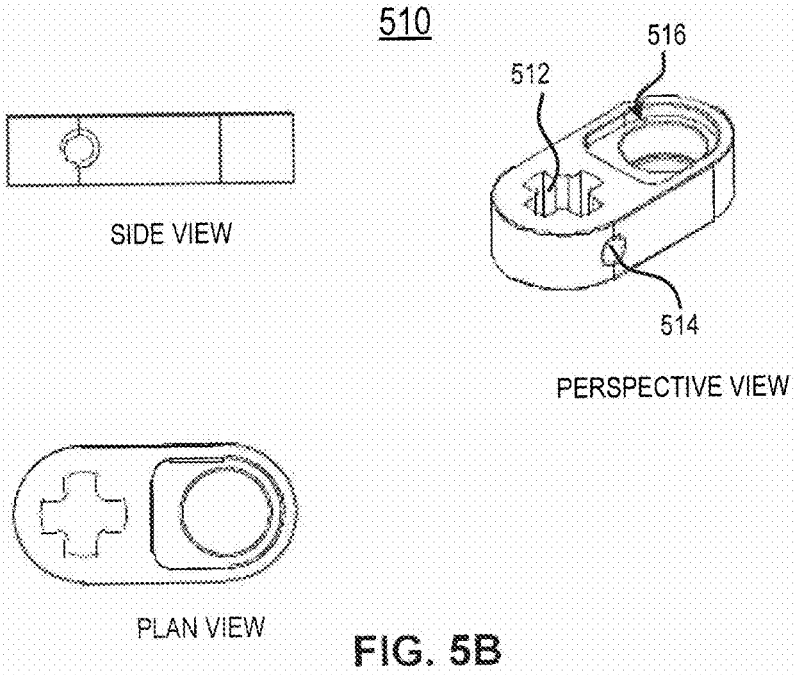
FIG. 5B depicts a perspective view, a side view, and a plan view of another example of a cross-hole beam in a toy construction set in accordance with an embodiment.

As described above, the through-holes in a beam are not limited to round holes and may have any shapes, such as through-hole 438 in FIG. 4E. In another type of beams, at least one of the through-holes is a cross hole, i.e., a through-hole with a "X" shape in the plan view. The cross hole may be configured to receive a cross shaft as described below in detail. This type of beams is called "cross-hole beams" as illustrated in FIGS. 5A-5B. For example, FIG. 5A depicts a perspective view, a side view, and a plan view of an example of a cross-hole beam 502 in a toy construction set in accordance with an embodiment. Cross-hole beam 502 includes a cross hole 504 and two round holes. A screw hole 506 is also provided in this embodiment through the wall of cross-hole beam 502 to cross hole 504. Screw hole 506 may be configured to receive a screw for further securing the cross shaft inserted into cross hole 504. It is to be appreciated that in this embodiment, two grooves 508 on the two major surfaces, respectively, of cross-hole beam 502 do not extend to the entire major surfaces as occurred in the example beams in FIGS. 2A-2B, 3A-3C, and 4A-4E. For example, the two round holes are within grooves 508, but cross hole 504 is outside grooves 508. Nevertheless, at each end of groove 508, the respective edge is still curved in cross-hole beam 502.

FIG. 5B depicts a perspective view, a side view, and a plan view of another example of a cross-hole beam 510 in a toy construction set in accordance with an embodiment. Similar to cross-hole beam 502, cross-hole beam 510 includes a cross hole 512 and a screw hole 514. Instead of having two round holes, cross-hole beam 510 includes one round hole, which is within grooves 516. In this embodiment, at one end of groove 516, the respective edge is curved, while at another end of groove 516, the respective edge is straight. That is, in the plan view, each groove 516 has a substantially "D" shape. It is to be appreciated that, unless explicitly described and/or illustrated otherwise, each example cross-hole beam in FIGS. 5A-5B may share the same properties, e.g., the material of the beams and the dimensions and shape of the grooves and through-holes, as the example straight beam 200 described in FIG. 2A-2B. For example, the depth of each groove may be substantially the same. It is also to be appreciated that the sizes of shaped beams are not limited to the example shaped beams in FIGS. 5A-5B. For example, the length (the number of through-holes) in a cross-hole beam may vary in different examples.

Connectors

The connectors in the toy construction sets disclosed herein are the parts used for interconnecting the construction elements and/or other connectors in the toy construction sets with the help of the fastening elements. Each connector may include two or more portions facing different directions. Each portion may include one or more through-holes for connecting one or more construction elements or other connectors. In some embodiments, the connectors include orthogonal connectors and 3D connectors. As described below in detail, the orthogonal connectors share some similar properties: each orthogonal connector including a first portion having a first through-hole and a second portion having a second through-hole; an axis of the first through-hole in the first portion being perpendicular to an axis of the second through-hole in the second portion; each of the first and second portions including two grooves on two major surfaces, respectively, of the respective portion along an axis of the first or second through-hole in the respective portion. The 3D connectors further share some additional similar properties: each 3D connector also including a third portion having a third through-hole; an axis of the third through-hole in the third portion being perpendicular to each of the axes of the second and third through-holes in the second and third portions, respectively; the third portion including two grooves on two major surfaces, respectively, along an axis of the third through-hole. Each connector, however, may have a different number of through-holes in each portion (e.g., 1, 2, 3, etc.), and the through-holes may have different shapes in the plan view (e.g., round, stadium, cross, etc.), and the overall configuration of each connector may be different. In some embodiments, the connector may be made from a metal material (including metal alloy materials), such as but not limited to, aluminum alloy, stainless steel, copper alloy, aluminum, copper, tin, iron, nickel, etc.

Figure 6:
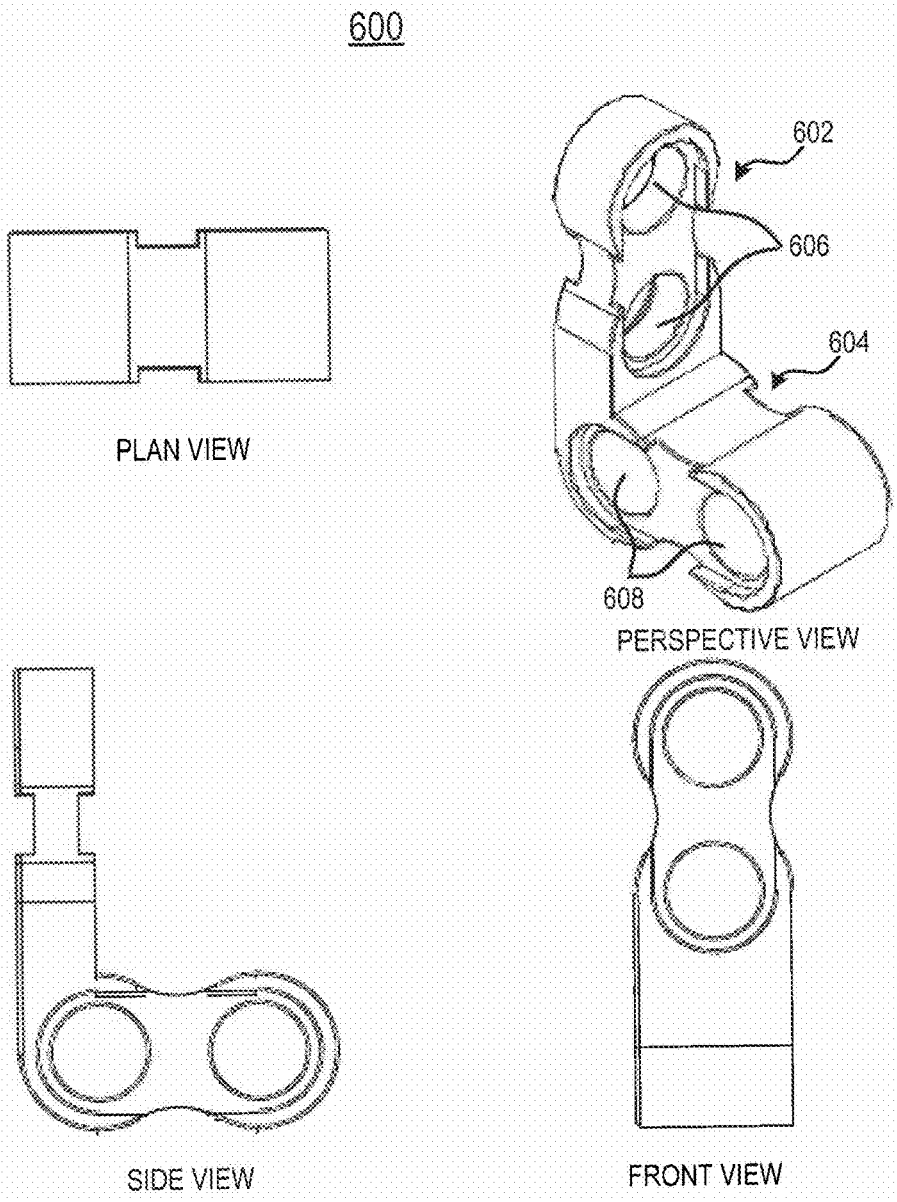
FIG. 6 depicts a perspective view, a side view, a front view, and a plan view of an example of an orthogonal connector in a toy construction set in accordance with an embodiment.

FIG. 6 depicts a perspective view, a side view, a front view, and a plan view of an example of an orthogonal connector 600 in a toy construction set in accordance with an embodiment. In this embodiment, orthogonal connector 600 includes a first portion 602 and a second portion 604 facing two directions that are perpendicular to one another. First portion 602 has two through-holes 606 and two grooves on the two major surfaces, respectively. Second portion 604 also has two through-holes 608 and two grooves on the two major surfaces, respectively. In this embodiment, the wall of each of first and second portions 602 and 604 does not extend along the entire edge of the respective portion. That is, each groove is not completely surrounded by the wall. In this embodiment, as shown in the perspective, front, and side views, at each of the two ends of each groove, the edge is curved. For example, the degree of curvature of the edge at each end of the groove may be substantially the same as the degree of curvature of the respective through-hole at the end, i.e., a semicircle. In this embodiment, the depth of each of the four grooves is substantially the same.

As described below in detail, each of first and second portions 602 and 604 may connect one or more construction elements and/or other connectors using the respective through-hole(s) and groove. As first and second portions 602 and 604 face two orthogonal directions, the construction elements or connectors interconnected by orthogonal connector 600 face orthogonal directions as well. In this embodiment, the dimensions of orthogonal connector 600 follow the general rules as set forth in FIGS. 2A-2B with respect to straight beam 200. For example, the distance between each through-hole 606 or 608 is 8 mm; the thickness of first portion 602 is 4 mm, and the width of first portion is 8 mm; the thickness of second portion 604 is 8 mm (the same as the width of first portion 602), and the width of second portion is 8 mm. The depth and width of each of the four grooves are 0.8 mm and 6.1 mm, respectively. Orthogonal connector 600 in this embodiment may be named as "2-2 orthogonal connector" because each of first and second portions 602 and 604 has two through-holes.

Figure 7A:
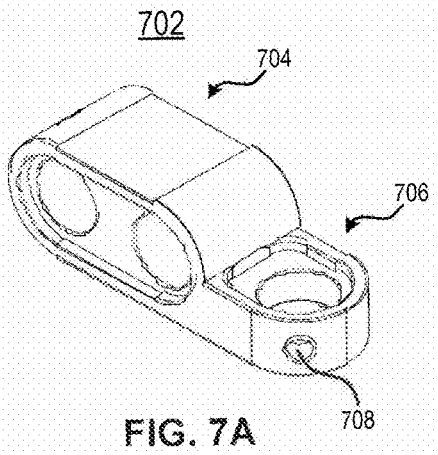
FIGS. 7A-7E are perspective views of examples of orthogonal connectors in a toy construction set in accordance with various embodiments.
Figure 7B:
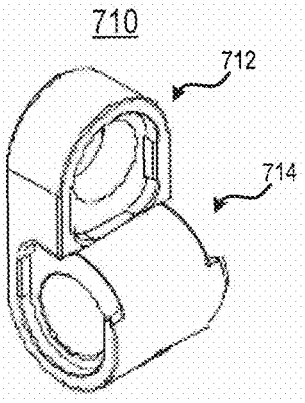

FIGS. 7A-7E are perspective views of examples of orthogonal connectors in a toy construction set in accordance with various embodiments. As described above, the length (number of through-holes) of each portion of an orthogonal connector may vary in different embodiments. In addition to 2-2 orthogonal connector 600 shown in FIG. 6, a 2-1 orthogonal connector 702 and a 1-1 orthogonal connector 710 are shown in FIGS. 7A-7B, respectively, as examples of orthogonal connectors with different lengths (numbers of through-holes therein). As shown in FIG. 7A, 2-1 orthogonal connector 702 includes a first portion 704 having two through-holes therein and a second portion 706 having one through-hole therein. The axis of each through-hole in first portion 704 is perpendicular to the axis of the through-hole in second portion 706. In this embodiment, a screw hole 708 is provided through the wall of second portion 706 to the through-hole. As described above, screw hole 708 may be configured to receive a screw for further securing any fastening element inserted into the through-hole. As shown in FIG. 7B, 1-1 orthogonal connector 710 includes a first portion 712 having one through-hole and a second portion 714 having one through-hole. The axes of the two through-holes are perpendicular to one another. Different from orthogonal connector 600 in FIG. 6, the wall of each portion of orthogonal connectors 702 and 710 extends along the entire edge of the respective portion. That is, each groove is completely surrounded by the respective wall in orthogonal connectors 702 and 710. In these embodiments, the dimensions of orthogonal connectors 702 and 710 follow the general rules as set forth in FIGS. 2A-2B with respect to straight beam 200.

Figure 7C:
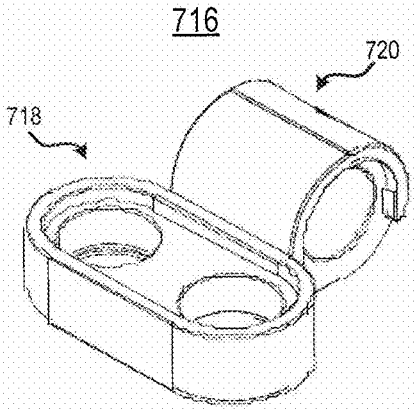
Figure 7D:
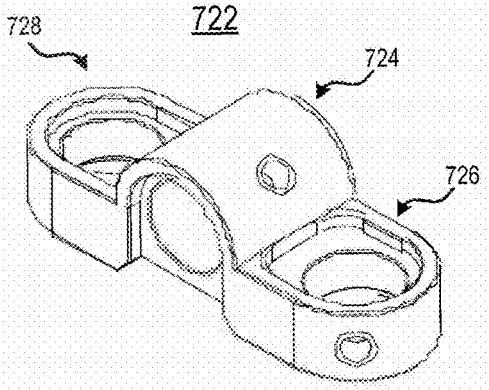
Figure 7E:
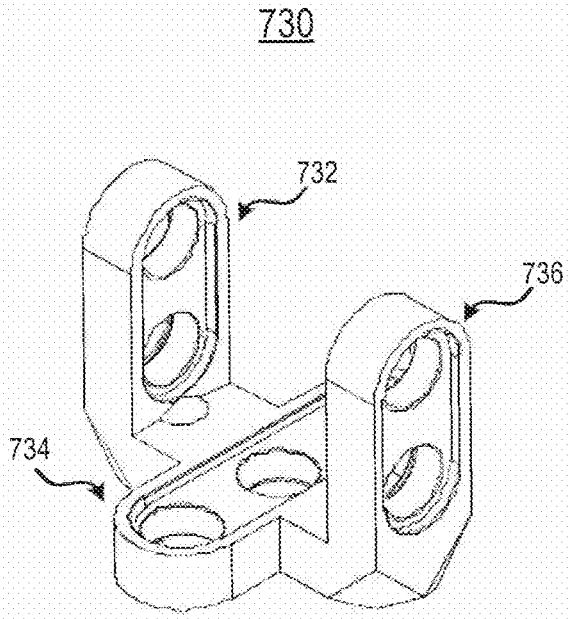

As shown in FIG. 7C, a 2-1 orthogonal connector 716 includes a first portion 718 having two through-holes therein and a second portion 720 having one through-hole therein. Different from 2-1 orthogonal connector 702 in FIG. 7A in which second potion 706 extends from one end of first portion 704, second portion 720 of 2-1 orthogonal connector 716 extends from the middle of first portion 718 of 2-1 orthogonal connector 716. In some embodiments, an orthogonal connector may have more than two portions. For example, as shown in FIG. 7D, a 1-1-1 orthogonal connector 722 includes three potions: a first portion 724, a second portion 726, and a third portion 728, each of which has one through-hole therein. Because second and third portions 726 and 728 face, the same direction, i.e., the axes of the two through-holes in second and third portions 726 and 728 are parallel to one another, orthogonal connector 722 is still considered an orthogonal connector, instead of a 3D connector. In this embodiment, two screw holes are provided through the walls of first and second portions 724 and 726 to the through-holes, respectively. As shown in FIG. 7E, a 2-3-2 orthogonal connector 730 includes a first portion 732 having two through-holes therein, a second portion 734 having three through-holes therein, and a third portion 736 having two through-holes therein. First and third portions 732 and 736 face the same direction, i.e., the axes of the through-holes in first and third portions 732 are parallel to one another. Different from 1-1-1 orthogonal connector 722 in FIG. 7D in which second and third portions 726 and 728 each extending from one respective end of first portion 724, first and third portions 732 and 736 of 2-3-2 orthogonal connector 730 each extends from the middle of second portion 734 of 2-3-2 orthogonal connector 730 in a direction along the axis of the through-holes in second portion 734.

Figure 8:
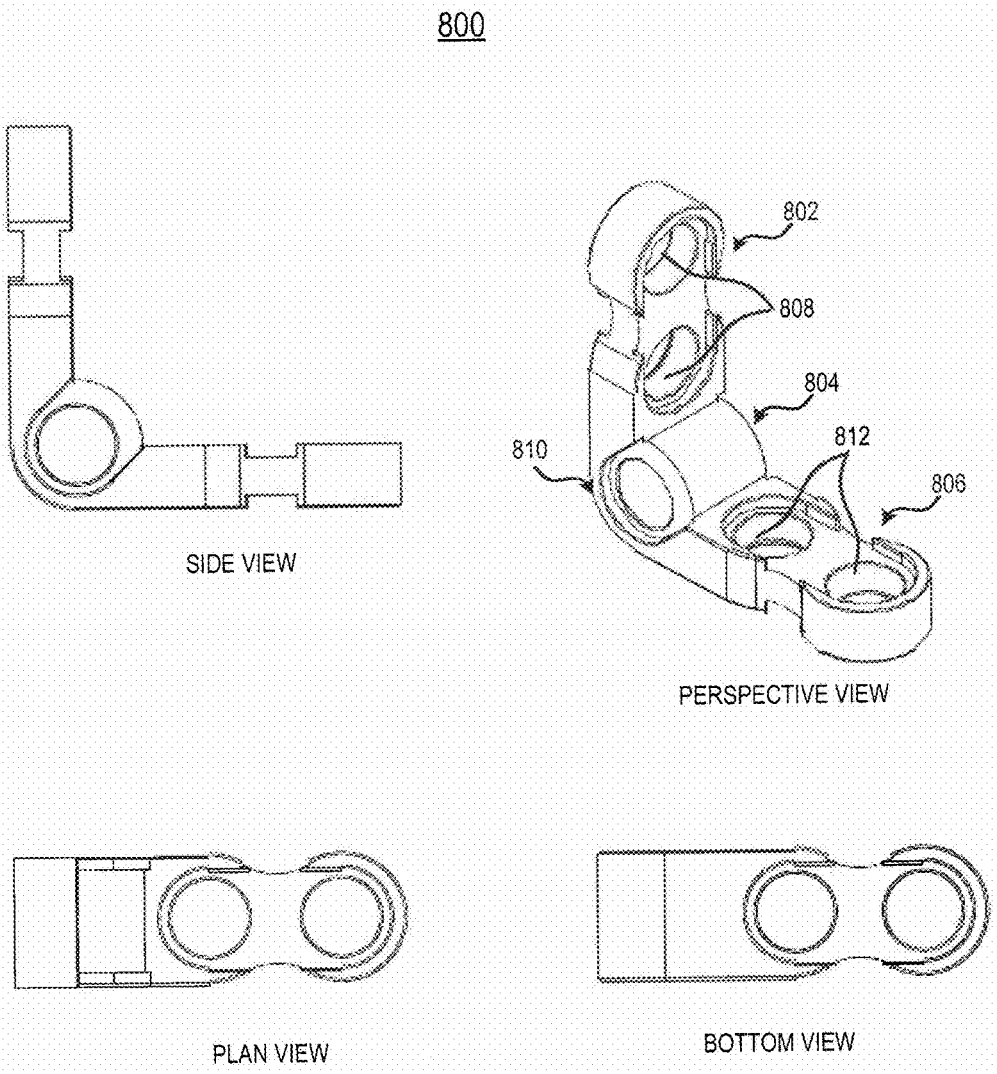
FIG. 8 depicts a perspective view, a side view, a bottom view, and a plan view of an example of a three-dimensional (3D) connector in a toy construction set in accordance with an embodiment.

FIG. 8 depicts a perspective view, a side view, a bottom view, and a plan view of an example of a three-dimensional (3D) connector 800 in a toy construction set in accordance with an embodiment. In this embodiment, 3D connector 800 includes a first portion 802, a second portion 804, and a third portion 806 each facing directions that are perpendicular to one another. First portion 802 has two through-holes 808 and two grooves on the two major surfaces, respectively. Second portion 804 has one through-hole 810 and two grooves on the two major surfaces, respectively. Third portion 806 has two through-holes 812 and two grooves on the two major surfaces, respectively. In this embodiment, the wall of each of first, second, and third portions 802, 804, and 806 does not extend along the entire edge of the respective portion. That is, each groove is not completely surrounded by the respective wall. In this embodiment, as shown in the perspective, front, and side views, at each of the two ends of the grooves of first and third portions 802 and 806, the edge is curved. As to the grooves of second portion 804, as shown in the perspective and side views, part of the edge of each groove is curved as well. For example, the degree of curvature of the edge at each end of the groove may be substantially the same as the degree of curvature of the through-hole at the respective end (or the single through-hole 810 of second portion 804), i.e., a semicircle. In this embodiment, the depth of each of the six grooves is substantially the same.

As described below in detail, each of first, second, and third portions 802, 804, and 806 may connect one or more construction elements and/or other connectors using the respective through-hole(s) and groove. As every two of first, second, and third portions 802, 804, and 806 face two orthogonal directions, respectively, the construction elements and/or connectors interconnected by 3D connector 800 face three orthogonal directions in a 3D space. In this embodiment, the dimensions of 3D connector 800 follow the general rules set forth in FIGS. 2A-2B with respect to straight beam 200. For example, the distance between each through-hole 808 or 812 is 8 mm; the thickness of first and third portions 802 and 806 is 4 mm, and the width of first and third portions 802 and 806 is 8 mm; the thickness of second portion 604 is 8 mm (the same as the width of first and third portions 802 and 806). The depth and width of each of the six grooves are 0.8 mm and 6.1 mm, respectively. 3D connector 800 in this embodiment may be named as "2-1-2 3D connector" because each of first and third portions 802 and 806 has two through-holes, and second portion 804 has one through-hole.

Figure 9A:
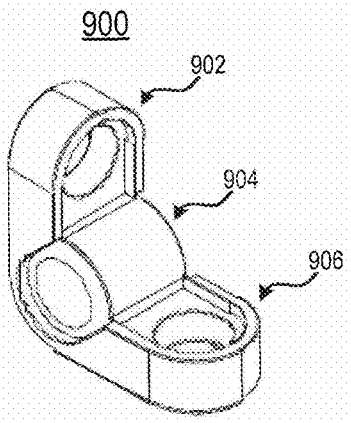
FIGS. 9A-9B are perspective views of examples of 3D connectors in a toy construction set in accordance with various embodiments.
Figure 9B:
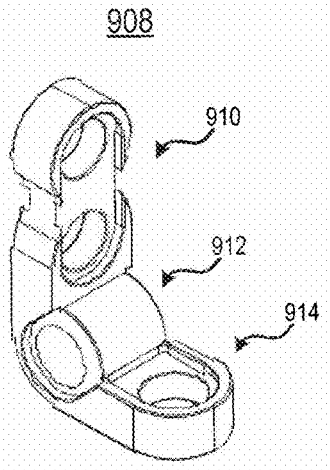

FIGS. 9A-9B are perspective views of examples of 3D connectors in a toy construction set in accordance with various embodiments. As described above, the length (number of through-holes) of each portion of a 3D connector may vary in different embodiments. In addition to 2-1-2 3D connector 800 shown in FIG. 8, a 1-1-1 3D connector 900 and a 2-1-1 3D connector 908 are shown in FIGS. 9A-9B, respectively, as examples of 3D connectors with different lengths (numbers of through-holes therein). As shown in FIG. 9A, 1-1-1 3D connector 900 includes a first portion 902, a second portion 904, and a third portion 906 each having one through-hole therein. The axes of every two through-holes are perpendicular to one another. As shown in FIG. 9B, 2-1-1 3D connector 908 includes a first portion 910 having two through-holes therein and a second and third portions 912 and 914 each having one through-hole therein. The axes of every two through-holes from different portions are perpendicular to one another.

Fastening Elements

The fastening elements in the toy construction sets disclosed herein are parts of the toy construction sets, when used in certain combinations, for coupling construction elements and/or connectors together in various manners, e.g., fixation, or rotatable joint. In some embodiments, the fastening elements include various types of base pins, such as fixation base pins and loose base pins. As described below in detail, these base pins share some similar properties: each including a body having a cavity and a member attached to one end of the body; a first portion of an edge of the member is curved and a second portion of the edge of the member is straight; a thickness of the member is substantially the same as the depth of each groove. Each base pin, however, may have a different height. In some embodiments, the fastening elements include various types of connection pins, such as fixation connection pins and loose connection pins. As described below in detail, these connection pins share some similar properties: each including a body having a cavity and a bolt. Each connection pin, however, may have a different height. In some embodiments, the fastening elements further include fasteners, stepped fasteners, washers, cross shafts, screws, etc. In some embodiments, the fastening elements may be made from a metal material (including metal alloy materials), such as but not limited to, aluminum alloy, stainless steel, copper alloy, aluminum, copper, tin, iron, nickel, etc.

Figure 10:
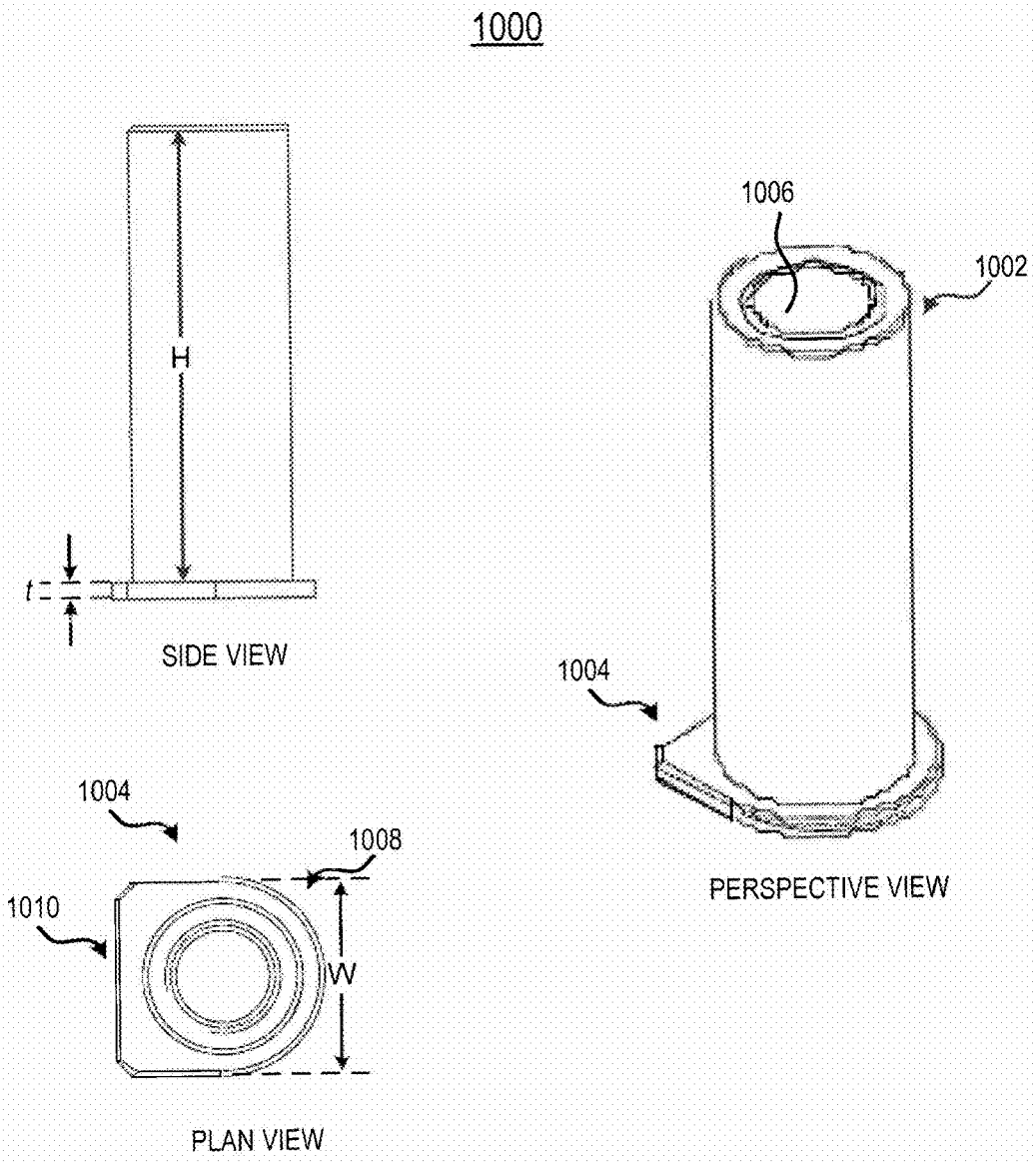
FIG. 10 depicts a perspective view, a side view, and a plan view of an example of a fixation base pin in a toy construction set in accordance with an embodiment.

FIG. 10 depicts a perspective view, a side view, and a plan view of an example of a fixation base pin 1000 in a toy construction set in accordance with an embodiment. In this embodiment, fixation base pin 1000 includes a body 1002 and a member 1004 attached to one end of body 1002. In this embodiment, body 1002 is in a substantially cylinder shape and includes a cavity 1006 extending from member 1004 to another end of body 1002. In some embodiments, cavity 1006 may have threads on the inner surface to mate with a screw or a bolt with threads. It is to be appreciated that in some embodiments, cavity 1006 may not have threads on the inner surface. As shown in the side view, the height H of body 1002 is measured from the upper surface of body 1002 to the upper surface of member 1004. As shown in the plan view, a first portion 1008 of the edge of member 1004 is curved, and a second portion 1010 of the edge of member 1004 is straight. Member 1004 has the width W measured between two parallel straight edges. In this embodiment, the width W of member 1004 is substantially the same as the width of the grooves of construction elements and connectors described above. In some embodiments, the width W of member 1004 is 6.1 mm, which is the same as the width of the groove (e.g., the width w of groove 210) of a beam or a connector. In this embodiment, the edge of member 1004 is in a substantially "D" shape. As shown in the side view, member 1004 has the thickness t measured from the upper surface to the lower surface of member 1004. In this embodiment, the thickness t is not larger than the depth of the grooves of the construction elements and connectors described above. In some embodiments, the thickness t of member 1004 is 0.6 mm, which is smaller than the depth of the groove (0.8 mm) of a beam or a connector.

As described below in detail, the design of member 1004 fits the design of the grooves of the construction elements and connectors described above. As a result, when body 1002 of fixation base pin 1000 passes through a through-hole of a beam or a connector, member 1004 of fixation base pin 1000 is fixed in place in the respective groove to constrain fixation base pin from rotating with respect to the axis of body 1002. For example, in some embodiments, as the width W of member 1004 is substantially the same as the width of the respective groove, once member 1004 is embedded in the groove, rotation of member 1004 is prevented. The curved edge of member 1004 can also help member 1004 to fit into the respective groove, when body 1002 of fixation base pin 1000 is inserted into a through-hole that is in the vicinity of the end at which the edge of the respective groove is curved. Moreover, in some embodiments, as the thickness t of member 1004 is not larger than the depth of the respective groove, member 1004 can be completely embedded in the groove so as to save external space when body 1002 of fixation base pin 1000 is inserted into the through-hole.

Figure 11:
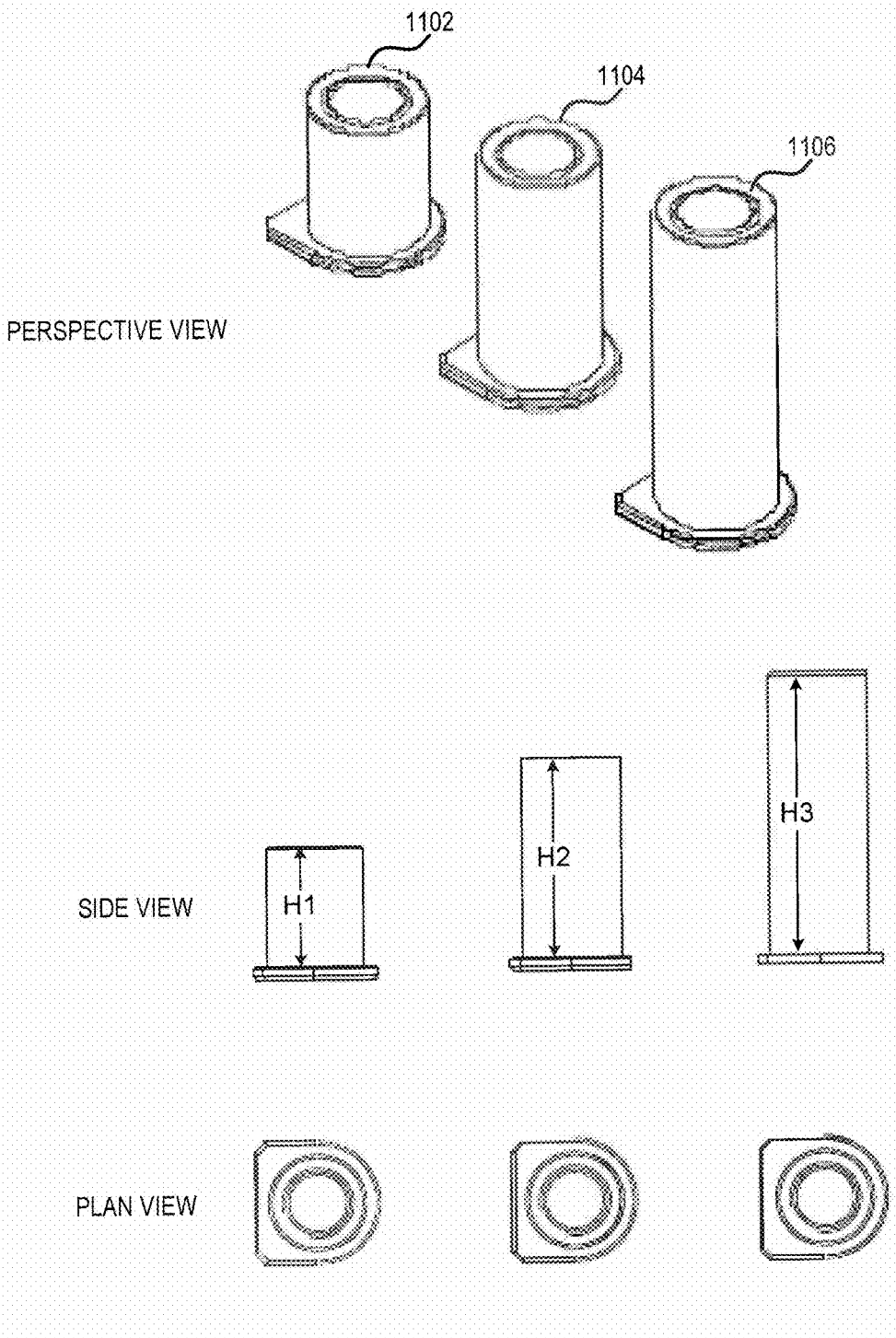
FIG. 11 depicts perspective views, side views, and plan views of examples of fixation base pins in a toy construction set in accordance with various embodiments.

FIG. 11 depicts perspective views, side views, and plan views of examples of fixation base pins in a toy construction set in accordance with various embodiments. Fixation base pins can have bodies with various heights to couple different numbers of construction elements and/or connectors. As shown in FIG. 11, fixation base pins 1102, 1104, and 1106 have the same members but different bodies with different heights H1, H2, and H3, respectively. For example, H1 may be set so that fixation base pin 1102 can fit two construction elements and/or connectors, H2 may be set so that fixation base pin 1104 can fit three construction elements and/or connectors, and H3 may be set so that fixation base pin 1106 can fit three construction elements and/or connectors. As described above, since each construction element or connector follows the general rules of design, the dimensions in the thickness direction (e.g., the thickness of the wall, the depth of the groove, and the depth of the through-hole) can be used to calculate the appropriate values of the heights H1, H2, and H3.

Figure 12:
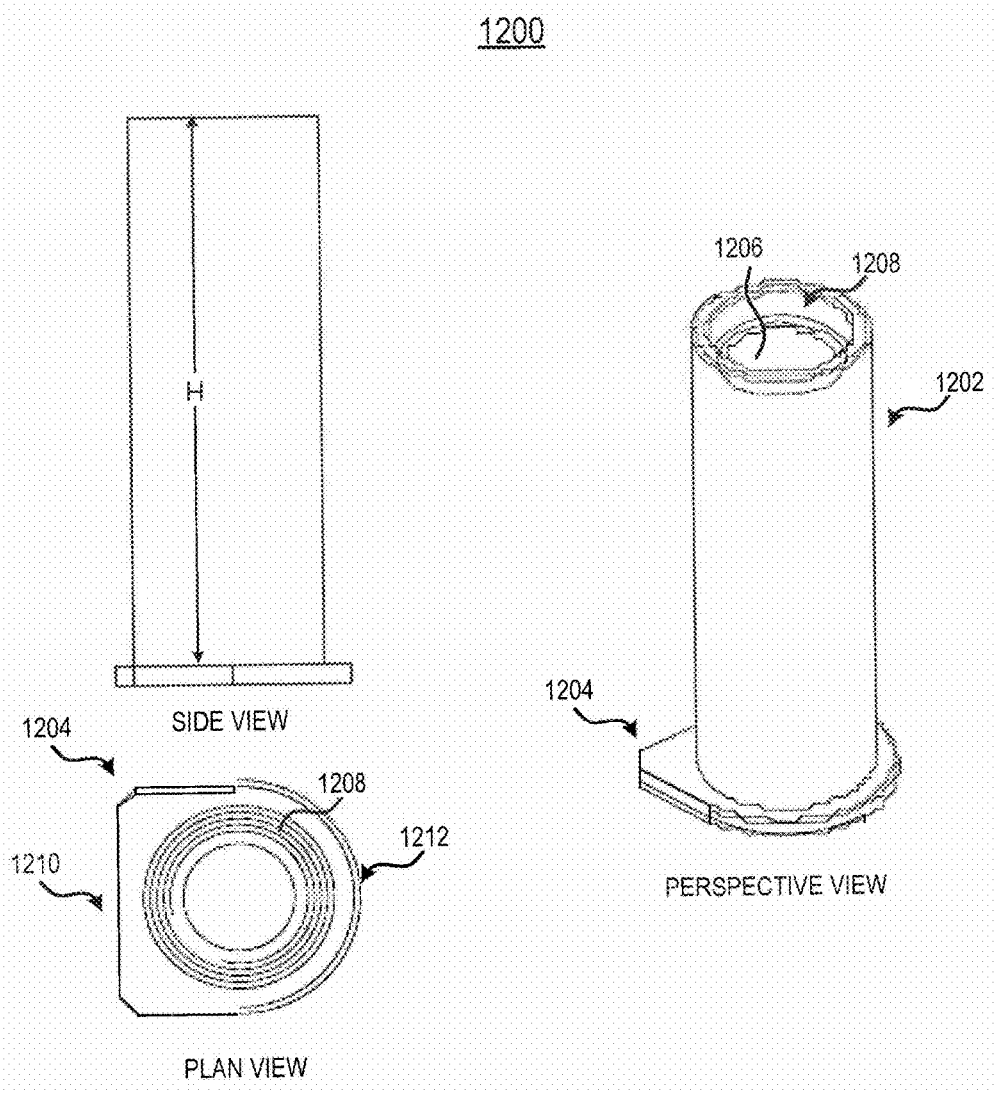
FIG. 12 depicts a perspective view, a side view, and a plan view of an example of a loose base pin in a toy construction set in accordance with an embodiment.

FIG. 12 depicts a perspective view, a side view, and a plan view of an example of a loose base pin 1200 in a toy construction set in accordance with an embodiment. In this embodiment, loose base pin 1200 includes a body 1202 and a member 1204 attached to one end of body 1202. Member 1204 shares the same properties as member 1004 of fixation base pin 1000, which are not repeated again in this embodiment. As to body 1202, it includes a cavity 1206 and a stepped groove 1208 on top of cavity 1206 at another end of body 1202. In this embodiment, stepped groove 1208 is adapted to receive a gasket, for example, an O-ring, to provide further security when loose base pin 1200 works in conjunction with a fastener to couple a plurality of construction elements and/or connectors. In some embodiments, the depth of stepped groove 1208 is 1 mm. Compared with fixation base pin 1000, in addition to having stepped groove 1208, the height H of body 1202 of loose base pin 1200 is also larger than the height of body 1002 of fixation base pin 1000 when fixation base pin 1000 and loose base pin 1200 are designed to couple the same number of construction elements and/or connectors. The same as fixation base pins, loose base pins also have different heights of bodies for coupling different numbers of construction elements and/or connectors. But for fixation base pins and loose base pins that used for coupling the same number of construction elements and/or connectors, the height of the bodies of the loose base pins is larger than the height of the bodies of the fixation base pins so as to provide the freedom of rotation to the coupled construction elements and/or connectors as described below in detail.

Figure 13:
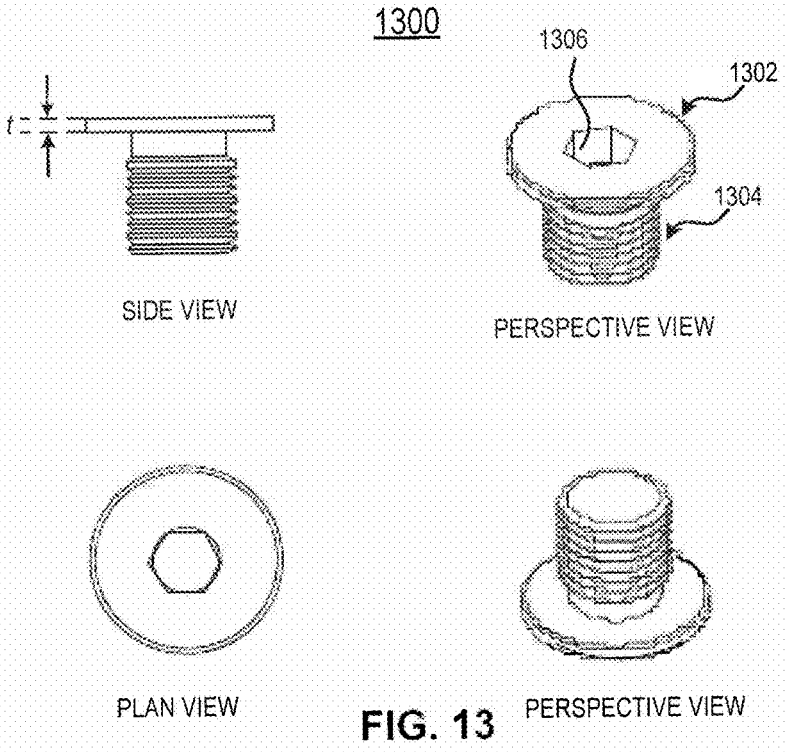
FIG. 13 depicts a top and a bottom perspective views, a side view, and a plan view of an example of a fastener in a toy construction set in accordance with an embodiment.

FIG. 13 depicts a top and a bottom perspective views, a side view, and a plan view of an example of a fastener 1300 in a toy construction set in accordance with an embodiment. Fasteners are another type of fastening elements that can be used in conjunction with base pins to couple a plurality of construction elements and/or connectors. In this embodiment, fastener 1300 includes a head 1302 and a body 1304. Head 1302 may have a hexagon cavity 1306 adapted to receive a hex key. In this embodiment, the thickness t of head 1302 is not larger than the depth of the grooves of the construction elements and connectors described above. In some embodiments, the thickness t of head 1302 is 0.6 mm, which is the same as the member of a base pin and is smaller than the depth of the groove (0.8 mm) of a beam or a connector. Similar to the member of a base pin, such thickness of head 1302 can ensure head 1302 to be completely embedded in the respective groove when fastener 1300 and a base pin are used to couple construction elements and/or connectors so as to save external space. In this embodiment, body 1304 of fastener 1300 has threads on the outer surface. It is to be appreciated that in some embodiments, body 1304 may not have threads on the outer surface. When fastener 1300 is used to couple construction elements and/or connectors with a base pin, body 1304 is inserted into the cavity of the body of the base pin (e.g., cavity 1006 of fixation base pin 1000 or cavity 1206 of loose base pin 1200) so that fastener 1300 and the base pin are jointed together.

Figure 14:
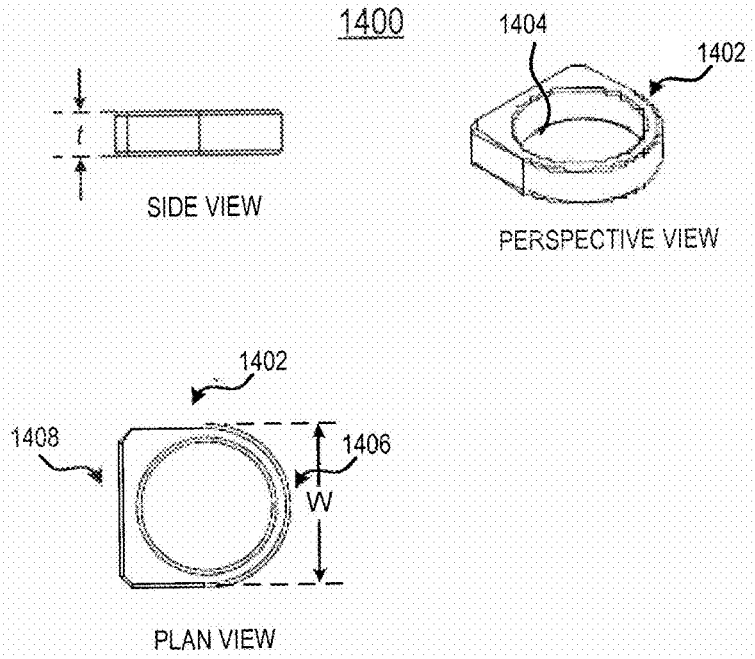
FIG. 14 depicts a perspective view, a side view, and a plan view of an example of a washer in a toy construction set in accordance with an embodiment.
Figure 15A:
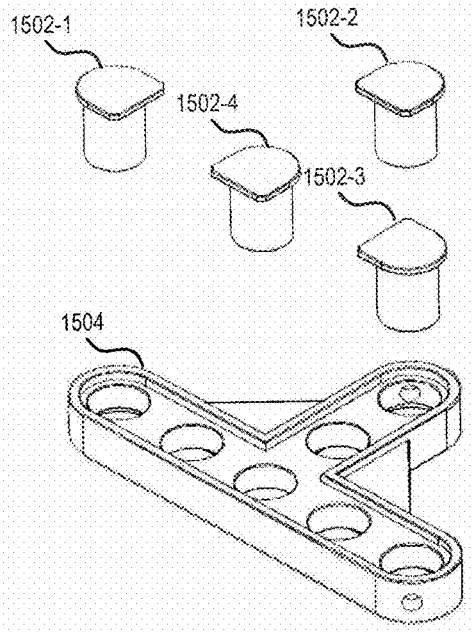
FIG. 15A depicts a perspective view of four base pins and a shaped beam in a toy construction set in accordance with an embodiment.
Figure 15B:
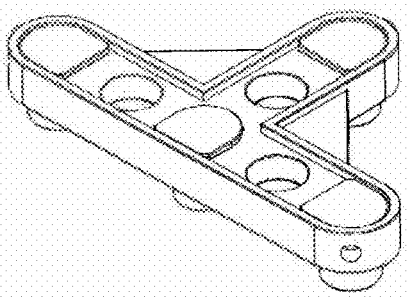
FIG. 15B depicts a perspective view of a structure assembled from the four base pins and the shaped beam in FIG. 15A in accordance with an embodiment.

FIG. 14 depicts a perspective view, a side view, and a plan view of an example of a washer 1400 in a toy construction set in accordance with an embodiment. Washers can be used with other fastening elements, such as fixation base pins and fasteners to prevent the relative rotation of the coupled construction elements and/or connectors when there is only one set of a fixation base pin and a fastener is used. In other words, washers can be used to enhance the fixation of multiple construction elements and/or connectors. In this embodiment, washer 1400 includes an edge 1402 having a through-hole 1404 therein. As shown in the plan view, a first portion 1406 of edge 1402 is curved, and a second portion 1408 of edge 1402 is straight. Edge 1402 of washer 1400 has the width W measured between two parallel straight edges. In this embodiment, the width W of edge 1402 is substantially the same as the width of the grooves of the construction elements and connectors described above. In some embodiments, the width W of edge 1402 is 6.1 mm, which is the same as the width of the groove (e.g., the width w of groove 210) of a beam or a connector. In this embodiment, edge 1402 of washer 1400 is in a substantially "D" shape. As shown in the side view, washer 1400 has the thickness t measured from the upper surface to the lower surface. In this embodiment, the thickness t is twice that of the depth of the grooves of the construction elements and connectors described above so as to constrain the coupled construction elements and/or connectors from rotating with respect to one another. In some embodiments, the thickness t of washer 1400 is 1.6 mm, which is twice that of the depth of the groove (0.8 mm) of a beam or a connector.

In this embodiment, the shape of edge 1402 of washer 1400 is substantially the same as that of the member of a base pin (e.g., member 1004 of fixation base pin 1000 or member 1204 of loose base pin 1200). Similar to the member of a base pin as described above, the design of washer 1400 can ensure that washer 1400 is disposed in a space formed between two coupled construction elements and/or connector so that the body of the base pin passes through through-hole 1404 of washer 1400. Also, as the width W of edge 1402 is substantially the same as the width of the respective groove, and the thickness t of washer 1400 is twice that of the depth of the respective groove, once washer 1400 is disposed in the space formed by the two grooves and surrounding walls, the relative rotation between the coupled construction elements and/or connectors can be prevented.

Coupling of construction elements and/or correctors by fastening elements, such as fixation base pins, loose base pins, fasteners, and washers, are now described by the examples in FIGS. 15-20. FIG. 15A depicts a perspective view of four base pins 1502 and a shaped beam 1504 in a toy construction set in accordance with an embodiment. FIG. 15B depicts a perspective view of a structure assembled from four base pins 1502 and shaped beam 1504 in FIG. 15A in accordance with an embodiment. In this example, shaped beam 1504 is the same as shaped beam 408 in FIG. 4B. Thus, the detail of shaped beam 1504 is not repeated again in this embodiment. Each base pin 1502 may be the same as fixation base pin 1000 or loose base pin 1200 in FIGS. 10 and 12, respectively. Again, the detail of base pin 1502 is not repeated again in this embodiment. In this example, three base pins 1502-1, 1502-2, and 1502-3 are coupled in the vicinities of the three ends of shaped beam 1504, respectively, and base pin 1502-4 is coupled at the middle of shaped beam 1504. The body of each base pin 1502 passes through the entirety of the respective through-hole in shaped beam 1504, and the member of each base pin 1502 is fixed in place in the groove of shaped beam 1504. As described above, because the thickness of the member of each base pin 1502 is not larger than the depth of the groove of shaped beam 1504, the members are completely embedded in the groove without any portions going outside the groove. For base pins 1502-1, 1502-2, and 1502-3 that are coupled in the vicinities of the ends of shaped beam 1504, the "D"-shaped edges of the members fit the curved edges of the groove at the ends. As to base pin 1502-4, the straight edge of the member fits the straight edge of the groove at the middle as well. Such fitting prevents each of base pins 1502-1, 1502-2, 1502-3, and 1502-4 from rotating with respect to an axis of the body of the respective base pin.

Figure 16A:
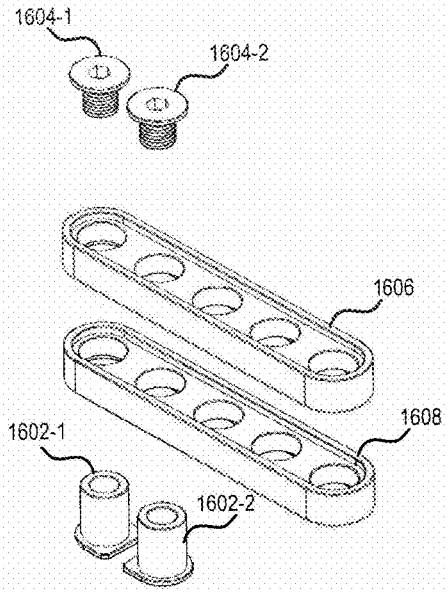
FIG. 16A depicts a perspective view of two fixation base pins, two fasteners, and two straight beams in a toy construction set in accordance with an embodiment.
Figure 16B:
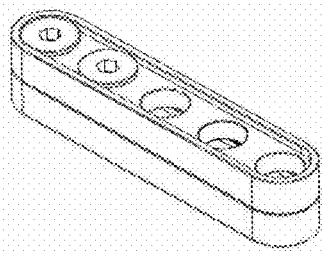
FIG. 16B depicts a perspective view of a structure assembled from the two fixation base pins, the two fasteners, and the two straight beams in FIG. 16A in accordance with an embodiment.
Figure 16C:
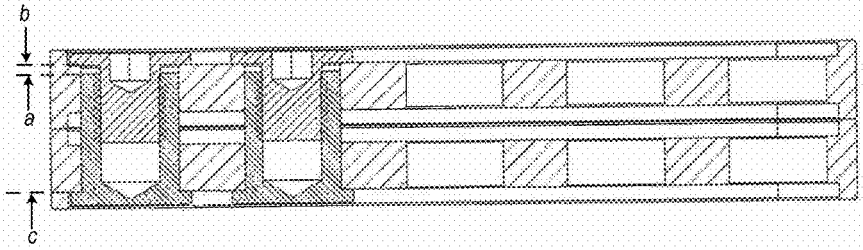
FIG. 16C depicts a cross-sectional view of the structure in FIG. 16B in accordance with an embodiment.

FIG. 16A depicts a perspective view of two fixation base pins 1602, two fasteners 1604, and two straight beams 1606 and 1608 in a toy construction set in accordance with an embodiment. FIG. 16B depicts a perspective view of a structure assembled from two fixation base pins 1602, two fasteners 1604, and two straight beams 1606 and 1608 in FIG. 16A in accordance with an embodiment. FIG. 16C depicts a cross-sectional view of the structure in FIG. 16B in accordance with an embodiment. In this example, each fixation base pin 1602 and a corresponding fastener 1604 are configured to couple two straight beams 1606 and 1608 by passing the body of fixation base pin 1602 through the entirety of the respective through-hole in straight beam 1608 and a portion of the respective through-hole in straight beam 1606 and by inserting the body of fastener 1604 into the cavity of fixation base pin 1602.

As shown in FIG. 16C, because the height of the body of fixation base pin 1602 is so designed that when the body of fixation base pin 1602 is inserted into the two aligned through-holes of coupled straight beams 1606 and 1608, the body of fixation base pin 1602 does not pass through the entirety of the respective through-hole in straight beam 1606 (it only passes through the entirety of the respective through-hole in straight beam 1608). That is, there is a gap between surface a (at one end of fixation base pin 1602) and surface b (groove in straight beam 1606). In other words, the end of fixation base pin 1602 is not in contact with the head of fastener 1604. The head of fastener 1604 is in contact with the groove in straight beam 1606 at surface b. The member of fixation base pin 1602 is in contact with the groove in straight beam 1608 at surface c. The height of the body of fixation base pin 1602 is smaller than the distance between surface b and surface c (the distance between the two grooves of coupled straight beams 1606 and 1608, respectively). As a result, the forces, which are created by the engagement of the head of fastener 1604 and the groove of straight beam 1606 at surface b and by the engagement of the member of fixation base pin 1602 and the groove of straight beam 1608 at surface c, mechanically affix straight beams 1606 and 1608 together.

It is to be appreciated that the joint forces created by one set of fixation base pin 1602 and fastener 1604 can prevent straight beams 1606 and 1608 from linear movement. As to the relative rotational movement between coupled straight beams 1606 and 1608, it may depend on the forces applied by the engagements of fixation base pin 1602 and fastener 1604 at surfaces c and b, respectively. In some embodiments, the forces created by one set of fixation base pin 1602 and fastener 1604 may be enough to prevent the relative rotational movement between coupled straight beams 1606 and 1608. In this embodiment, two sets of fixation base pins 1602 and fasteners 1604 are used to ensure that coupled straight beams 1606 and 1608 cannot rotate with respect to one another.

Figure 17A:
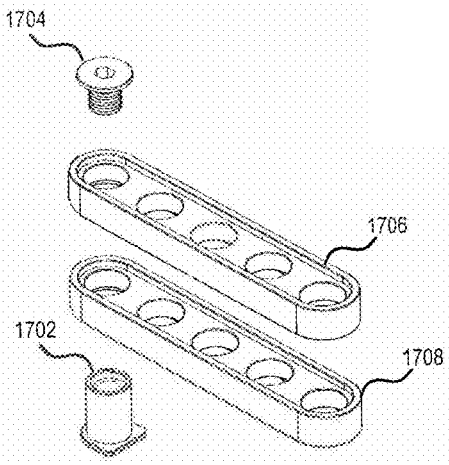
FIG. 17A depicts a perspective view of a loose base pin, a fastener, and two straight beams in a toy construction set in accordance with an embodiment.
Figure 17B:
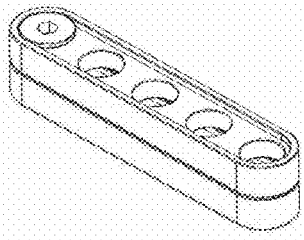
FIG. 17B depicts a perspective view of a structure assembled from the loose base pin, the fastener, and the two straight beams in FIG. 17A in accordance with an embodiment.
Figure 17C:
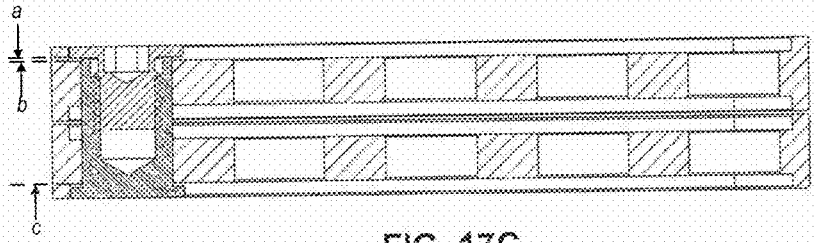
FIG. 17C depicts a cross-sectional view of the structure in FIG. 17B in accordance with an embodiment.

FIG. 17A depicts a perspective view of a loose base pin 1702, a fastener 1704, and two straight beams 1706 and 1708 in a toy construction set in accordance with an embodiment. FIG. 17B depicts a perspective view of a structure assembled from loose base pin 1702, fastener 1704, and two straight beams 1706 and 1708 in FIG. 17A in accordance with an embodiment. FIG. 17C depicts a cross-sectional view of the structure in FIG. 17B in accordance with an embodiment. In this example, loose base pins 1702 and fastener 1704 are configured to couple two straight beams 1706 and 1708 by passing the body of loose base pin 1702 through the entirety of the respective through-hole in straight beam 1708 and the entirety of the respective through-hole in straight beam 1706 and by inserting the body of fastener 1704 into the cavity of loose base pin 1702.

As shown in FIG. 17C, because the height of the body of loose base pin 1702 is so designed that when the body of loose base pin 1702 is inserted into the two aligned through-holes of coupled straight beams 1706 and 1708, the body of loose base pin 1702 passes through the entirety of the respective through-hole in straight beam 1708 as well as the entirety of the respective through-hole in straight beam 1708. In other words, the height of the body of loose base pin 1702 is smaller than the distance between surface b and surface c (the distance between the two grooves of coupled straight beams 1706 and 1708, respectively). One end of loose base pin 1702 is thus in contact with the head of fastener 1704 at surface a. In addition to the gap between surface a and surface b, another gap is also formed between the member of loose base pin 1702 and surface c. As a result, different from the example in FIGS. 16A-16C, the fastening structure formed by loose base pin 1702 and fastener 1704 couples straight beams 1706 and 1708 in a way that straight beams 1706 and 1708 can still rotate with respect to one another. In other words, a rotatable joint is formed for coupled straight beams 1706 and 1708 by loose base pin 1702 and fastener 1704. As discussed above, another difference between a loose base pin and a fixation base pin is that a loose base pin, such as loose base pin 1702, includes a stepped groove adapted to receive a gasket. In some embodiments, a gasket, such as an O-ring, may be inserted into the stepped groove of loose base pin 1702 to enhance the engagement between loose base pin 1702 and fastener 1704.

Figure 18A:
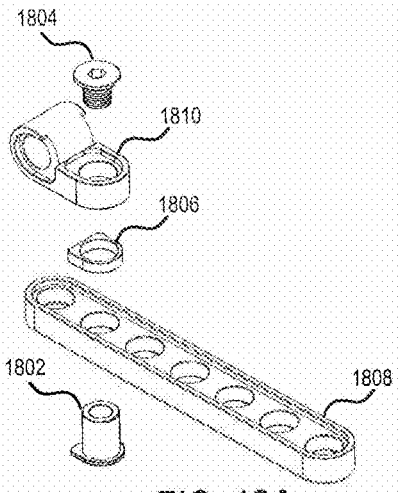
FIG. 18A depicts a perspective view of a fixation base pin, a fastener, a washer, a straight beam, and a connector in a toy construction set in accordance with an embodiment.
Figure 18B:
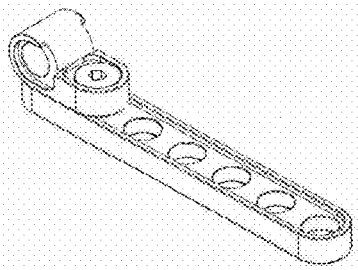
FIG. 18B depicts a perspective view of a structure assembled from the fixation base pin, the fastener, the washer, the straight beam, and the connector in FIG. 18A in accordance with an embodiment.
Figure 18C:
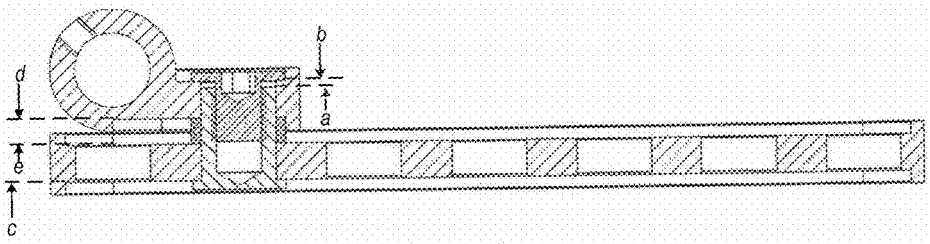
FIG. 18C depicts a cross-sectional view of the structure in FIG. 18B in accordance with an embodiment.

FIG. 18A depicts a perspective view of a fixation base pin 1802, a fastener 1804, a washer 1806, a straight beam 1808, and a connector 1810 in a toy construction set in accordance with an embodiment. FIG. 18B depicts a perspective view of a structure assembled from fixation base pin 1802, fastener 1804, washer 1806, straight beam 1808, and connector 1810 in FIG. 18A in accordance with an embodiment. FIG. 18C depicts a cross-sectional view of the structure in FIG. 18B in accordance with an embodiment. In this example, fixation base pin 1802, fastener 1804, and washer 1806 are configured to couple straight beams 1808 and connector 1810 by passing the body of fixation base pin 1802 through the entirety of the respective through-hole in straight beam 1808, the entirety of the through-hole in washer 1806, and a portion of the respective through-hole in connector 1810 and by inserting the body of fastener 1804 into the cavity of fixation base pin 1802. In the formed structure, washer 1806 is disposed in a space formed between coupled straight beams 1808 and connector 1810.

Similar to the example in FIGS. 16A-16C, as shown in FIG. 18C, there is a gap between surface a (the end of fixation base pin 1802) and surface b (groove in connector 1810). In other words, the end of fixation base pin 1802 is not in contact with the head of fastener 1804. The head of fastener 1804 is in contact with the groove in connector 1810 at surface b. The member of fixation base pin 1802 is in contact with the groove in straight beam 1808 at surface c. The height of the body of fixation base pin 1802 is smaller than the distance between surface c and surface b (the distance between the two grooves of coupled straight beams 1808 and connector 1810, respectively). As a result, the forces, which are created by the engagement of the head of fastener 1804 and the groove of connector 1810 at surface b and by the engagement of the member of fixation base pin 1802 and the groove of straight beam 1808 at surface c, mechanically affix straight beams 1808 and connector 1810 together.

As discussed above in the example in FIGS. 16A-16C, the relative rotational movement between coupled straight beams 1808 and connector 1810 may depend on the forces applied by the engagements of fixation base pin 1802 and fastener 1804 at surfaces c and b, respectively. In some embodiments, the forces created by one set of fixation base pin 1802 and fastener 1804 may be enough to prevent the relative rotational movement between coupled straight beams 1808 and connector 1810. In this embodiment, washer 1806 is used to prevent the relative rotational movement. The thickness of washer 1806 may be substantially the same as the distance between surface e and surface d (the grooves of coupled straight beams 1808 and connector 1810, respectively). That is, the thickness of washer 1806 may be twice that of the depth of the grooves of straight beam 1808 and connector 1810. As discussed above, the width of washer 1806 may be substantially the same as the width of the grooves of straight beam 1808 and connector 1810. Thus, washer 1806 can constrain coupled straight beams 1808 and connector 1810 from rotating with respect to one another. It is to be appreciated that in some embodiments the "D"-shape of washer 1806 ensures that washer 1806 can fit into any portion in the grooves of straight beam 1808 or connector 1810 including the ends with the curved edge.

Figure 19A:
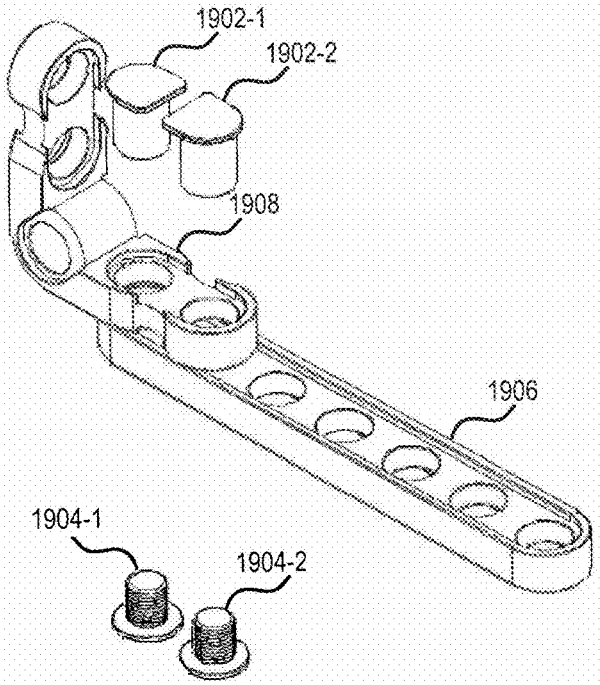
FIG. 19A depicts a perspective view of two fixation base pins, two fasteners, a straight beam, and a connector in a toy construction set in accordance with an embodiment.
Figure 19B:
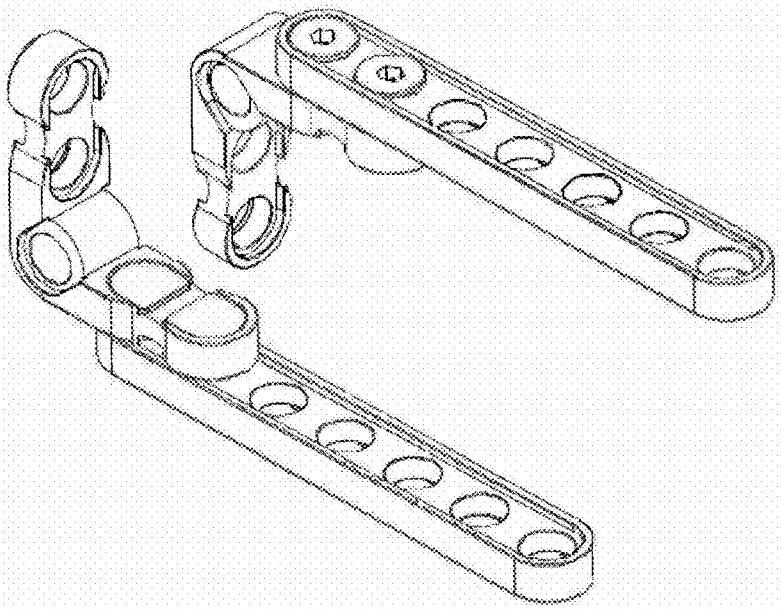
FIG. 19B depicts a perspective view of two structures, each of which is assembled from the two fixation base pins, the two fasteners, the straight beam, and the connector in FIG. 19A in accordance with an embodiment.

FIG. 19A depicts a perspective view of two fixation base pins 1902, two fasteners 1904, a straight beam 1906, and a connector 1908 in a toy construction set in accordance with an embodiment. FIG. 19B depicts a perspective view of two structures, each of which is assembled om two fixation base pins 1902, two fasteners 1904, straight beam 1906, and connector 1908 in FIG. 19A in accordance with an embodiment. In this example, each fixation base pin 1902 and a corresponding fastener 1904 are configured to couple straight beam 1906 and connector 1908 by passing the body of fixation base pin 1902 through the entirety of the respective through-hole in connector 1908 and a portion of the respective through-hole in straight beam 1906 and by inserting the body of fastener 1904 into the cavity of fixation base pin 1902. In this example, two sets of fixation base pins 1902 and fasteners 1904 are used to constrain coupled straight beams 1906 and connector 1908 from rotating with respect to one another. The "D"-shaped members of fixation base pins 1902 and the smaller thickness compared with the depth of the groove of connector 1908 ensure that the members of fixation base pins 1902 can fit the curved edges of the groove of connector 1908 and can be completely embedded in the groove. Once the members of fixation base pins 1902 are embedded in the groove of connector 1908, the members are fixed in place to constrain fixation base pins 1902 from rotating with respect to the axes of the bodies of fixation base pins 1902, respectively.

Figure 20:
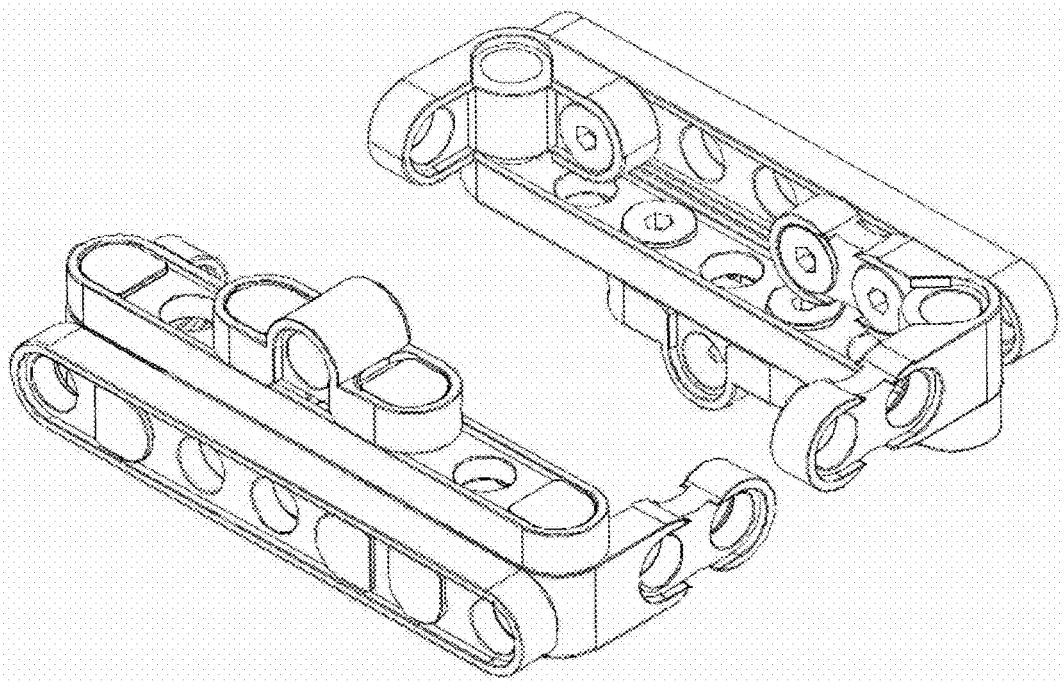
FIG. 20 depicts a perspective view of an example of a structure assembled from various fixation base pins, fasteners, straight beams, and connectors in a toy construction set in accordance with an embodiment.

FIG. 20 depicts a perspective view of an example of a structure assembled from various fixation base pins, fasteners, straight beams, and connectors in a toy construction set in accordance with an embodiment. In this example, multiple construction elements, such as straight beams, and connectors, such as orthogonal connectors and 3D connectors, are mechanically affixed together by a plurality sets of fixation base pins and fasteners. All members of the fixation base pins and heads of the fasteners are completely embedded in the respective groove to save external space. Also, the dimensions and shapes of the members of the fixation base pins ensure that the members are fixed in place in the respective groove to constrain each fixation base pin from rotating with respect to an axis of the body of the fixation base pin. The connectors in conjunction with the fixation base pins and fasteners can interconnect construction elements and/or other connectors so that the interconnected construction elements and/or other connectors face directions that are perpendicular to one another.

Figure 21:
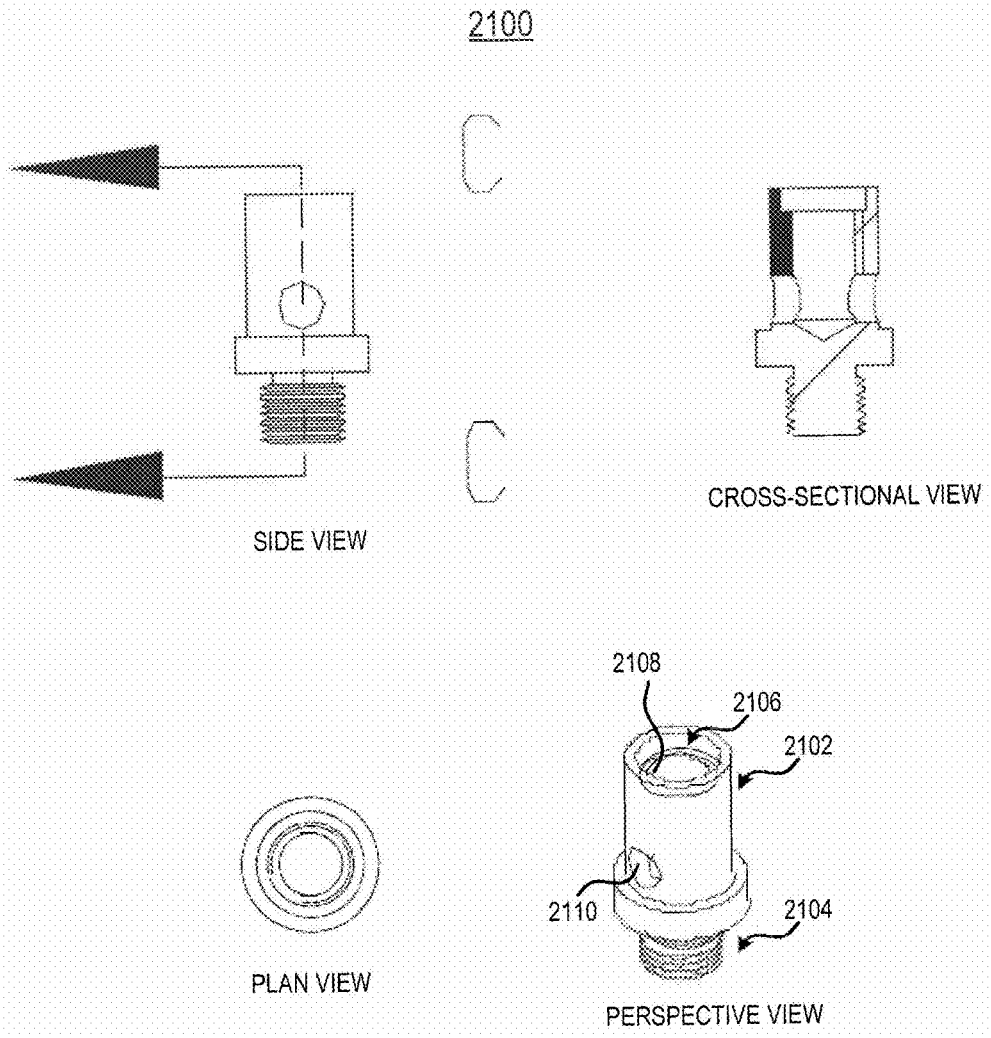
FIG. 21 depicts a perspective view, a side view, a cross-sectional view and a plan view of an example of a loose connection pin in a toy construction set in accordance with an embodiment.

FIG. 21 depicts a perspective view, a side view, a cross-sectional view and a plan view of an example of a loose connection pin 2100 in a toy construction set in accordance with an embodiment. In this embodiment, loose connection pin 2100 includes a body 2102 and a bolt 2104. Body 2102 includes a stepped groove 2106 at one end of body 2102, which is adapted to receive a gasket. Body 2102 further includes a cavity 2108 extending from stepped groove 2106 to one end of bolt 2104. In this embodiment, bolt 2104 includes threads on the outer surface. In some embodiments, cavity 2108 may include threads on the inner surface. In this embodiment, cavity 2108 is configured to receive the bolt of another connection pin or the body of a fastener, and bolt 2104 is configured to be inserted into the cavity of another connection pin or the cavity of a base pin. That is, loose connection pin 2100 can work as both a base pin and a fastener for coupling construction elements and/or connectors that are spaced apart as described below in detail. In this embodiment, a screw hole 2110 may be provided through body 2102 to cavity 2108 and configured to receive a screw for further securing the part inserted in cavity 2108.

Figure 22:
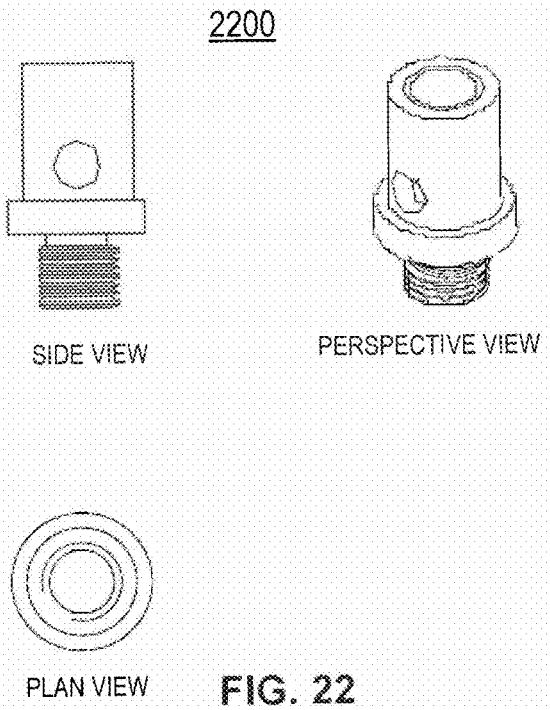
FIG. 22 depicts a perspective view, a side view, and a plan view of an example of a fixation connection pin in a toy construction set in accordance with an embodiment.

FIG. 22 depicts a perspective view, a side view, and a plan view of an example of a fixation connection pin 2200 in a toy construction set in accordance with an embodiment. Fixation connection pin 2200 shares the similar properties as loose connection pin 2100 in FIG. 21 except that fixation connection pin 2200 does not include a stepped groove so that the cavity has the uniform diameter extending from one end of the bolt to one end of the body of fixation connection pin 2200. Also, as discussed above with respect to fixation base pins and loose base pins, the height of the body of fixation connection pin 2200 is also smaller than that of loose connection pin 2100 so that when used to couple construction elements and/or connectors, fixation connection pin 2200 can mechanically affix the coupled construction elements and/or connectors (with a washer or a second fixation connection pin) while loose connection pin 2100 can form a rotatable joint.

Figure 23:
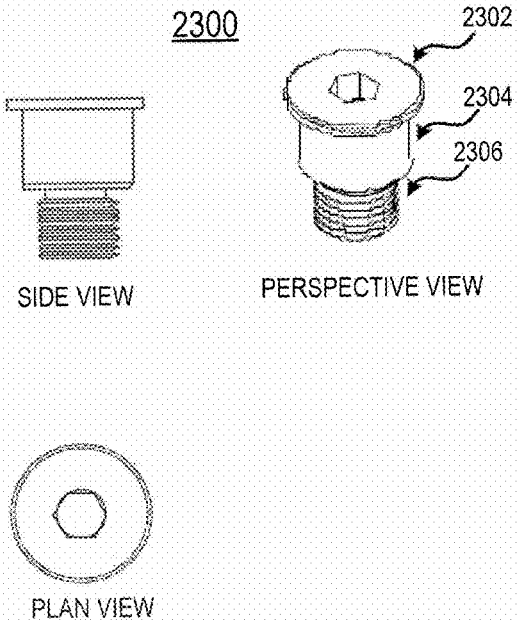
FIG. 23 depicts a perspective view, a side view, and a plan view of an example of a stepped fastener in a toy construction set in accordance with an embodiment.

FIG. 23 depicts a perspective view, a side view, and a plan view of an example of a stepped fastener 2300 in a toy construction set in accordance with an embodiment. In this embodiment, stepped fastener 2300 includes a head 2302, a base 2304, and a bolt 2306. Stepped fastener 2300 shares the similar properties as fastener 1300 in FIG. 13 except that stepped fastener 2300 further includes base 2304, which can increase the total length of stepped fastener so that stepped fastener 2300 can replace fastener 1300 to couple thick construction elements at d/or connectors. It is to be appreciated that depending on the height of base 2304, stepped fastener 2300 can be a loose stepped fastener or a fixation stepped fastener.

Figure 24A:
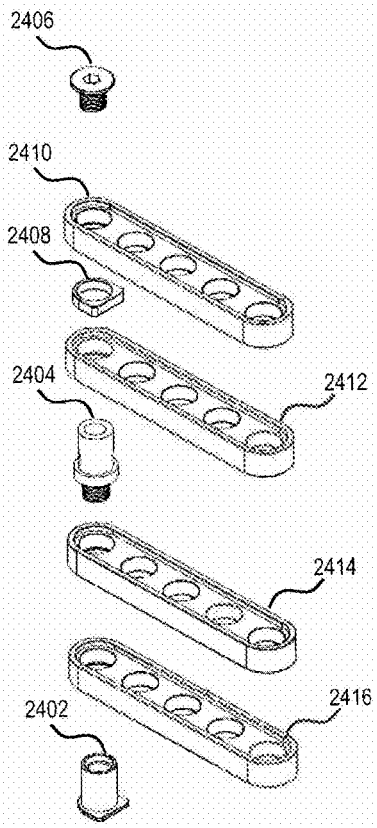
FIG. 24A depicts a perspective view of a loose base pin, a connection pin, a fastener, a washer, and four straight beams in a toy construction set in accordance with an embodiment.
Figure 24B:
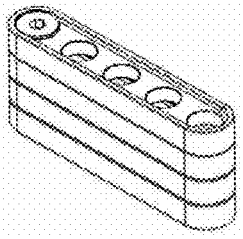
FIG. 24B depicts a perspective view of a structure assembled from the loose base pin, the connection pin, the fastener, the washer, and the four straight beams in FIG. 24A in accordance with an embodiment.
Figure 24C:
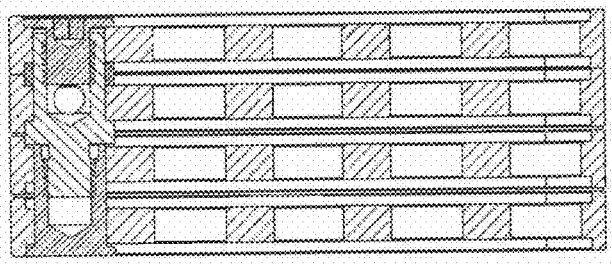
FIG. 24C depicts a cross-sectional view of the structure in FIG. 24B in accordance with an embodiment.

FIG. 24A depicts a perspective view of a loose base pin 2402, a fixation connection pin 2404, a fastener 2406, a washer 2408, and four straight beams 2410, 2412, 2414, and 2416 in a toy construction set in accordance with an embodiment. FIG. 24B depicts a perspective view of a structure assembled from loose base pin 2402, fixation connection pin 2404, fastener 2406, washer 2408, and four straight beams 2410, 2412, 2414, and 2416 in FIG. 24A in accordance with an embodiment. FIG. 24C depicts a cross-sectional view of the structure in FIG. 24B in accordance with an embodiment. In this example, loose base pin 2402, fixation connection pin 2404, fastener 2406, and washer 2408 are configured to couple the four straight beams 2410, 2412, 2414, and 2416. For example, straight beams 2414 and 2416 are coupled by passing the body of loose base pin 2402 through the entirety of the respective through-hole in straight beam 2416 and the entirety of the respective through-hole in straight beam 2414 and by inserting the bolt of fixation connection pin 2404 into the cavity of loose base pin 2402. Straight beams 2410 and 2412 are coupled by passing the body of fixation connection pin 2404 through the entirety of the respective through-hole in straight beam 2412, the entirety of the through-hole in washer 2408, and a portion of the respective through-hole in straight beam 2410 and by inserting the body of fastener 2406 into the cavity of fixation connection pin 2404. As a result, the construction elements that are spaced apart, such as straight beams 2410 and 2414, straight beams 2410 and 2416, straight beams 2412 and 2416, can be coupled together by fixation connection pin 2404.

As shown in FIG. 24C and discussed above with respect to FIGS. 17A-17C, the set of loose base pin 2402 and fixation connection pin 2404 can couple straight beams 2414 and 2416 while allowing coupled straight beams 2414 and 2416 to rotate with respect to one another, i.e., forming a rotatable joint. As discussed above with respect to FIGS. 18A-18C, the set of fixation connection pin 2404, washer 2408, and fastener 2406 can couple straight beams 2410 and 2412 by mechanically affixing coupled straight beams 2410 and 2412 so as to constrain coupled straight beams 2410 and 2412 from rotating with respect to one another.

Figure 25A:
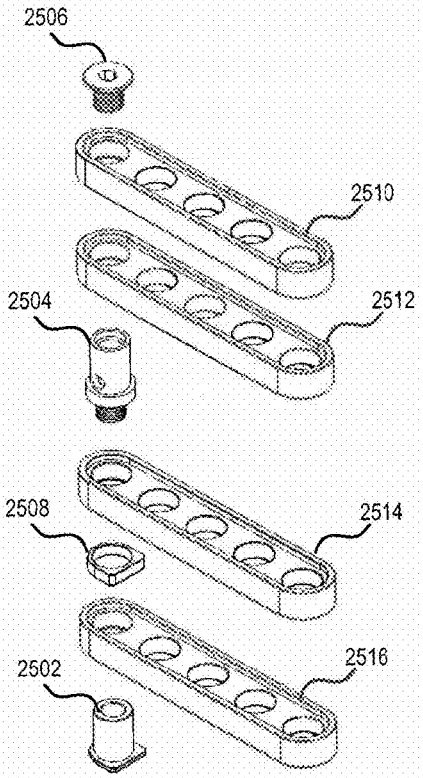
FIG. 25A depicts a perspective view of a fixation base pin, a connection, pin, a fastener, a washer, and four straight beams in a toy construction set in accordance with an embodiment.
Figure 25B:
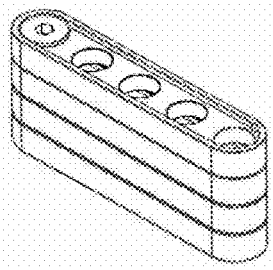
FIG. 25B depicts a perspective of a structure assembled from the fixation base pin, the connection pin, the fastener, the washer, and the four straight beams in FIG. 25A in accordance with an embodiment.
Figure 25C:
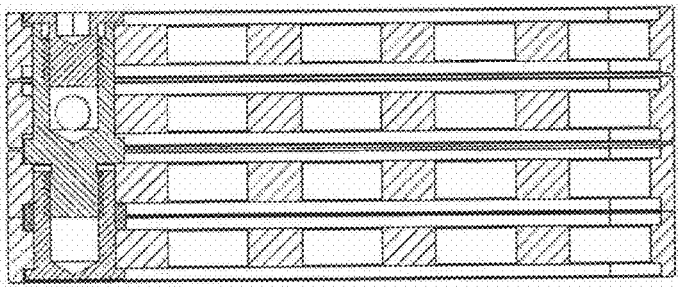
FIG. 25C depicts a cross-sectional view of the structure in FIG. 25B in accordance with an embodiment.

FIG. 25A depicts a perspective view of a fixation base pin 2502, a loose connection pin 2504, a fastener 2506, a washer 2508, and four straight beams 2510, 2512, 2514, and 2516 in a toy construction set in accordance with an embodiment. FIG. 25B depicts a perspective of a structure assembled from fixation base pin 2502, loose connection pin 2504, fastener 2506, washer 2508, and four straight beams 2510, 2512, 2514, and 2516 in FIG. 25A in accordance with an embodiment. FIG. 25C depicts a cross-sectional view of the structure in FIG. 25B in accordance with an embodiment. In this example, fixation base pin 2502, loose connection pin 2504, fastener 2506, and washer 2508 are configured to couple four straight beams 2510, 2512, 2514, and 2516. For example, straight beams 2514 and 2516 are coupled by passing the body of fixation base pin 2502 through the entirety of the respective through-hole in straight beam 2516, the entirety of the through-hole in washer 2508, and a portion of the respective through-hole in straight beam 2514 and by inserting the bolt of loose connection pin 2504 into the cavity of fixation base pin 2502. Straight beams 2510 and 2512 are coupled by passing the body of loose connection pin 2504 through the entirety of the respective through-hole in straight beam 2512 and the entirety of the respective through-hole in straight beam 2510 and by inserting the body of fastener 2506 into the cavity of loose connection pin 2504. As a result, the construction elements that are spaced apart, such as straight beams 2510 and 2514, straight beams 2510 and 2516, straight beams 2512 and 2516, can be coupled together by loose connection pin 2504.

As shown in FIG. 25C and discussed above with respect to FIGS. 18A-18C, the set of fixation base pin 2502, washer 2508, and loose connection pin 2504 can couple straight beam 2514 and 2516 by mechanically affixing coupled straight beams 2514 and 2516 so as to constrain coupled straight beams 2514 and 2516 from rotating with respect to one another. As discussed above with respect to FIGS. 17A-17C, the set of loose connection pin 2504 and fastener 2506 can couple straight beams 2510 and 2512 while allowing coupled straight beams 2510 and 2512 to rotate with respect to one another, i.e., forming a rotatable joint.

Figure 26A:
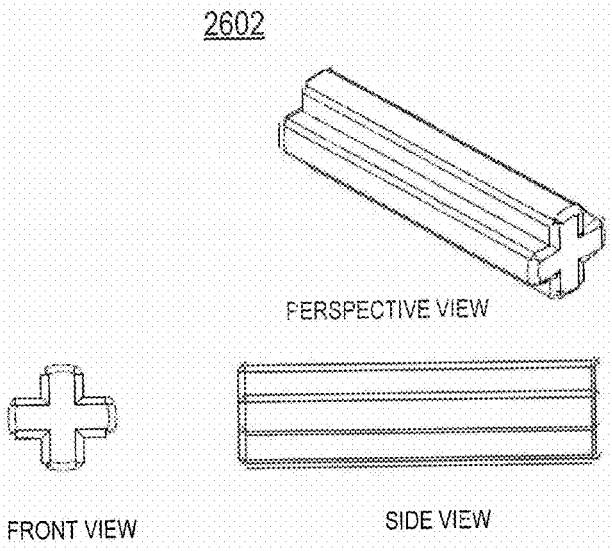
FIG. 26A depicts a perspective view, a side view, and a front view of an example of a cross shaft in a toy construction set in accordance with an embodiment.
Figure 26B:
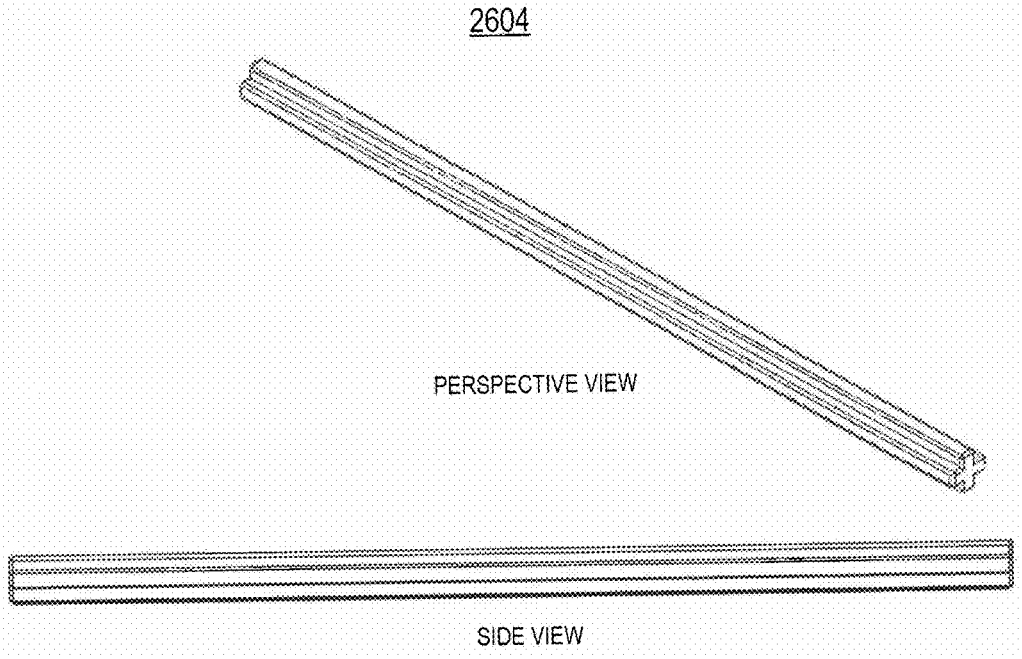
FIG. 26B depicts a perspective view and a side view of another example of a cross shaft in a toy construction set in accordance with an embodiment.

FIG. 26A depicts a perspective view, a side view, and a front view of an example of a cross shaft 2602 in a toy construction set in accordance with an embodiment. FIG. 26B depicts a perspective view and a side view of another example of a cross shaft 2604 in a toy construction set in accordance with an embodiment. In this example, each of cross shafts 2602 and 2604 has a cross shape in the front view. The length of cross shafts can vary in different examples, such as short cross shaft 2602 and long cross shaft 2604. Each of cross shafts 2602 and 2604 is configured to be inserted into a cross hole, such as cross holes 504 and 512 in cross-hole beams as shown in FIGS. 5A-5B.

Figure 27:
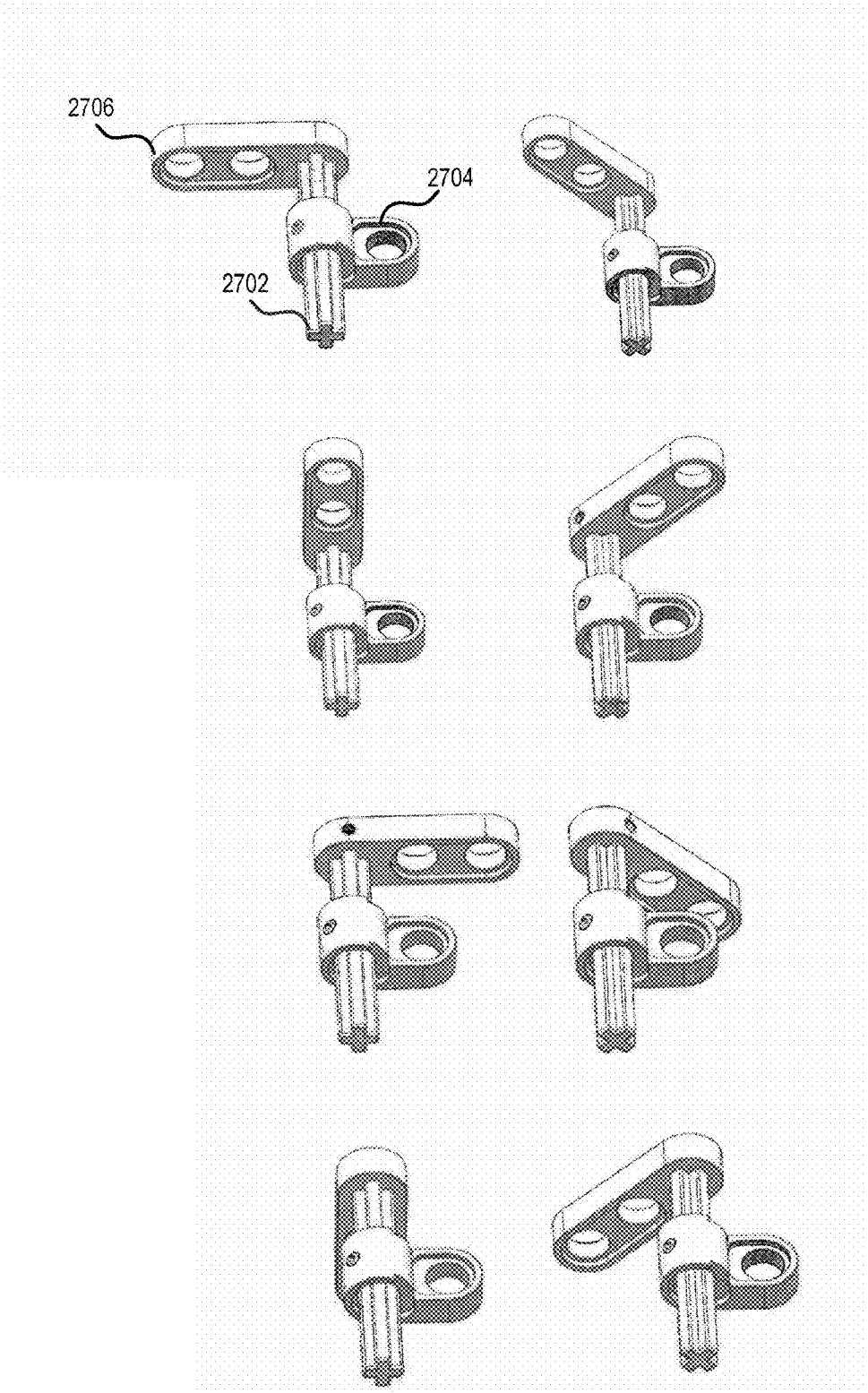
FIG. 27 depicts perspective views of eight structures assembled from a cross shaft, a connector, and a cross-hole beam in a toy construction set in accordance with an embodiment.

FIG. 27 depicts perspective views of eight structures assembled from a cross shaft 2702, a connector 2704, and a cross-hole beam 2706 in a toy construction set in accordance with an embodiment. As shown in FIG. 27, by changing the direction in which cross shaft 2702 is inserted into the cross hole of cross-hole beam 2706, cross-hole beam 2706 can be coupled to connector 2704 in eight different relative directions. Thus, the combination of a cross shaft and a cross hole in any construction elements and/or connector can achieve interconnections in eight relative directions.

Figure 28:
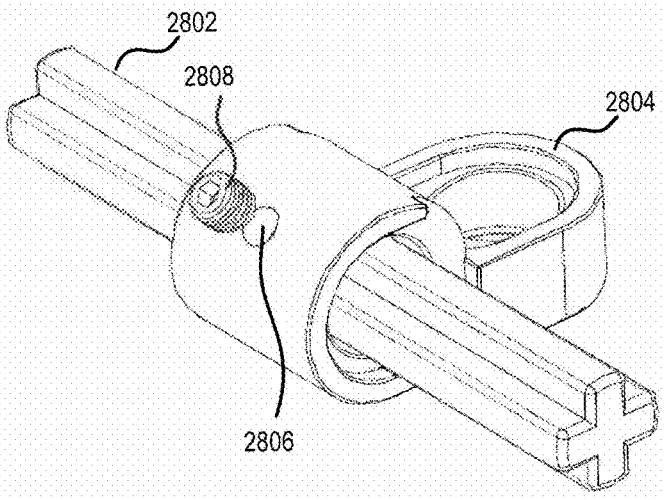
FIG. 28 is a perspective view of a structure assembled from a cross shaft, a connector with a threaded hole, and a screw in a toy construction set in accordance with an embodiment.

FIG. 28 is a perspective view of a structure assembled from a cross shaft 2802, a connector 2804 with a threaded hole 2806, and a screw 2808 in a toy construction set in accordance with an embodiment. In this embodiment, when cross shaft 2802 is inserted through a round through-hole in one portion of connector 2804, screw 2808 can be inserted via threaded hole 2806 to affix cross shaft 2802 inside the round through-hole of connector 2804.

Auxiliary Construction Elements

The auxiliary construction elements in the toy construction sets disclosed herein are the additional parts of the toy construction sets used for providing functions to the toys, such as rotational or linear movement. In some embodiments, the auxiliary construction elements include various types of construction elements, such as gears, racks, worms, pulleys, turntables, wheels, chains, tracks, etc. As described below in detail, the auxiliary construction elements share some similar properties: each including at least one structure that is adapted to receive the fastening elements of the toy construction sets described above so that the auxiliary construction elements can be coupled to other construction elements and/or connectors. In some embodiments, the auxiliary construction elements may be made from a metal material (including metal alloy materials), such as but not limited to, aluminum alloy, stainless steel, copper alloy, aluminum, copper, tin, iron, nickel, etc.

Figure 29:
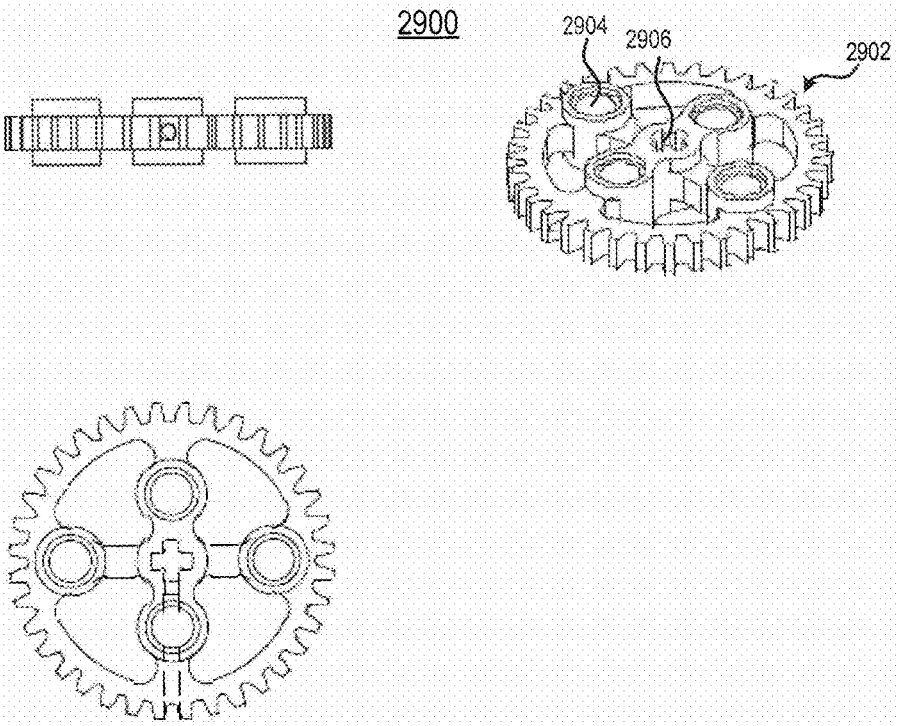
FIG. 29 depicts a perspective view, a side view, and a plan view of an example of a gear in a toy construction set in accordance with an embodiment.

FIG. 29 depicts a perspective view, a side view, and a plan view of an example of a gear 2900 in a toy construction set in accordance with an embodiment. In this embodiment, gear 2900 includes a body 2902 having a plurality of gear teeth along the edge, a plurality of round through-holes 2904 arranged along a circle, and a cross through-hole 2906 at the middle of body 2902. The dimensions and shape of round through-hole 2904 follow the general rules of through-holes described above so that gear 2900 can be coupled to other construction elements and/or connectors by fastening elements, such as base pins, connection pins, washers, and fasteners. The dimensions and shape of cross through-hole 2906 also follow the general rules of cross holes described above so that gear 2900 can be coupled to other construction elements and/or connectors by fastening elements, such as cross shafts and screws.

Figure 30:
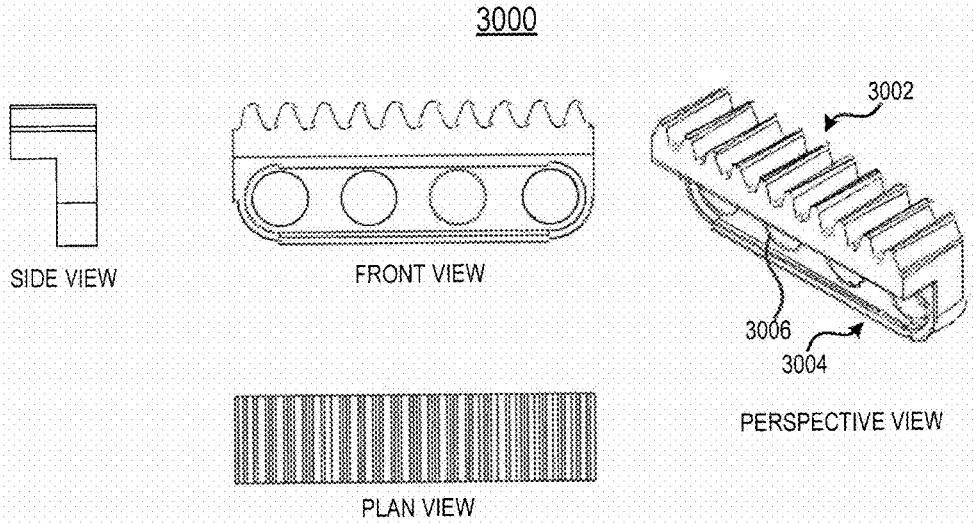
FIG. 30 depicts a perspective view, a side view, a front view, and a plan view of an example of a rack in a toy construction set in accordance with an embodiment.

FIG. 30 depicts a perspective view, a side view, a front view, and a plan view of an example of a rack 3000 in a toy construction set in accordance with an embodiment. In this embodiment, rack 3000 includes a body 3002 having a plurality of teeth on a flat plane. In order to be coupled to other construction elements and/or connectors, rack 3000 further includes a connection structure having a groove 3004 and a plurality of through-holes 3006. The dimensions and shape of groove 3004 and through-holes 3006 follow the general rules of the grooves and through-holes described above so that rack 3000 can be coupled to other construction elements and/or connectors by fastening elements, such as base pins, connection pins, washers, and fasteners.

Figure 31:
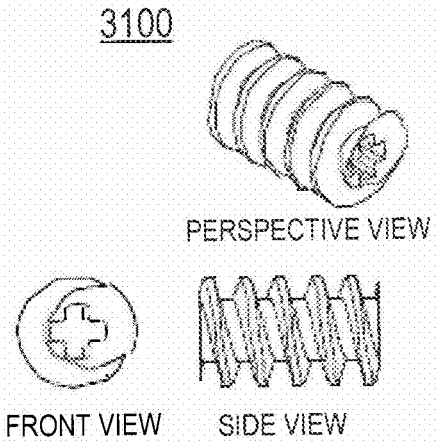
FIG. 31 depicts a perspective view, a side view, and a front view of an example of a worm in a toy construction set in accordance with an embodiment.

FIG. 31 depicts a perspective view, a side view, and a front view of an example of a worm 3100 in a toy construction set in accordance with an embodiment. In this embodiment, worm 3100 includes a cross hole. The dimensions and shape of the cross hole follow the general rules of cross holes described above so that worm 3100 can be coupled to other construction elements and/or connectors by fastening elements, such as cross shafts and screws.

Figure 32:
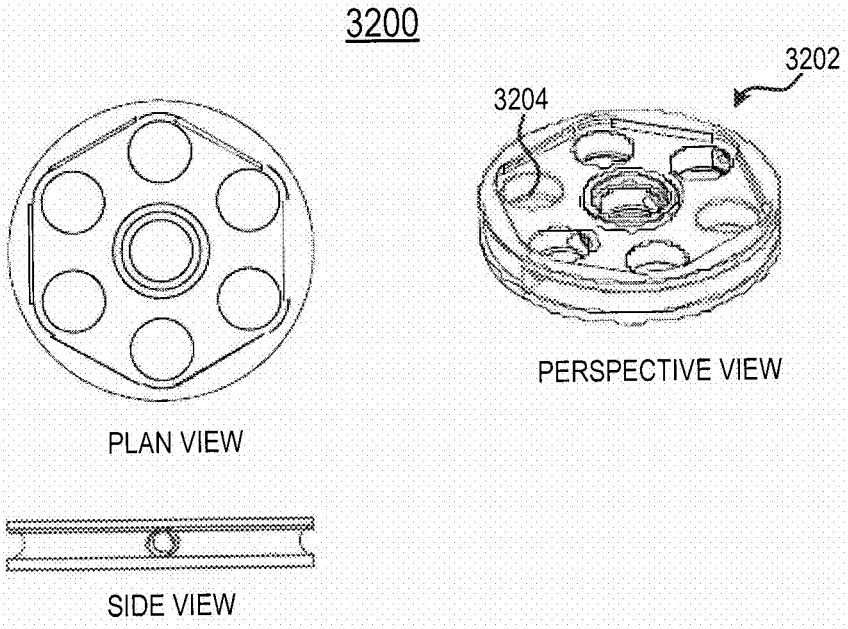
FIG. 32 depicts a perspective view, a side view, and a plan view of an example of a pulley in a toy construction set in accordance with an embodiment.

FIG. 32 depicts a perspective view, a side view, and a plan view of an example of a pulley 3200 in a toy construction set in accordance with an embodiment. In this embodiment, pulley 3200 includes a body 3202 having a groove rim along the edge and a plurality of through-holes 3204 arranged along a circle. The dimensions and shape of through-hole 3204 follow the general rules of through-holes described above so that pulley 3200 can be coupled to other construction elements and/or connectors by fastening elements, such as base pins, connection pins, washers, and fasteners.

Figure 33:
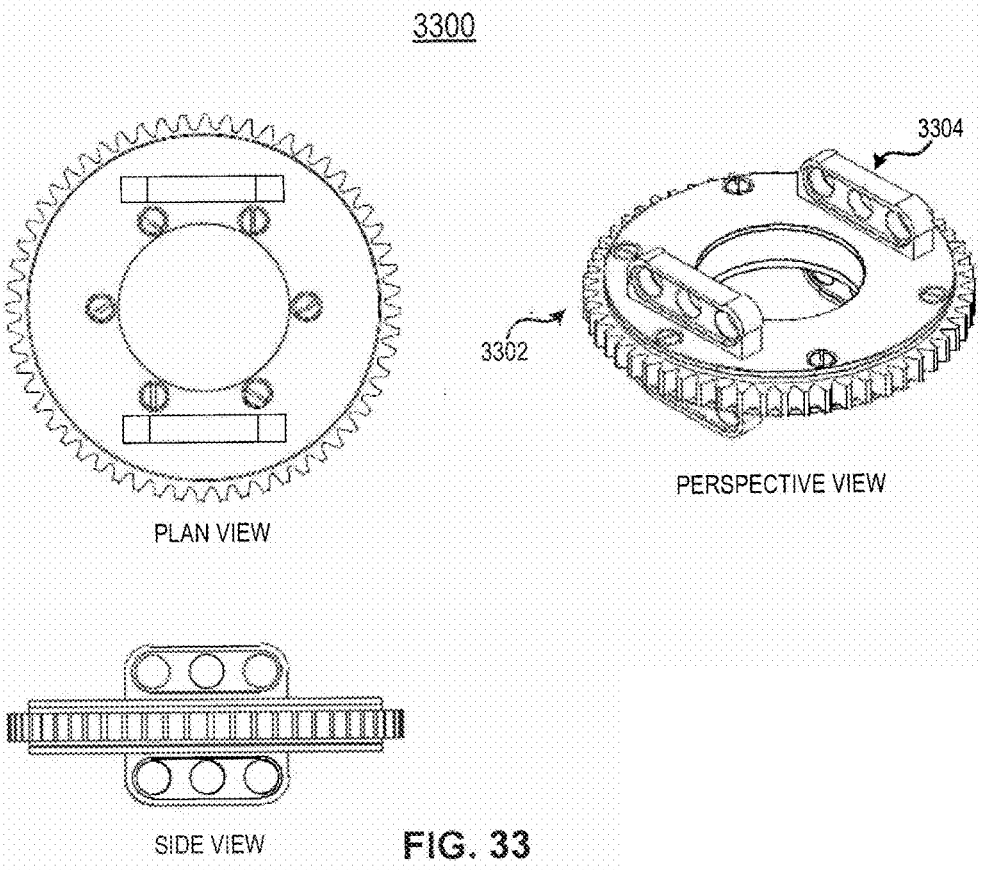
FIG. 33 depicts a perspective view, a side view, and a plan view of an example of a turntable in a toy construction set in accordance with an embodiment.

FIG. 33 depicts a perspective view, a side view, and a plan view of an example of a turntable 3300 in a toy construction set in accordance with an embodiment. In this embodiment, turntable 3300 includes a body 3302 having a plurality of teeth along the edge. In order to be coupled to other construction elements and/or connectors, turntable 3300 further includes two connection structures 3304 each having two grooves and a plurality of through-holes. The dimensions and shape of the grooves and through-holes follow the general rules of the grooves and through-holes described above so that turntable 3300 can be coupled to other construction elements and/or connectors by fastening elements, such as base pins, connection pins, washers, and fasteners.

Figure 34:
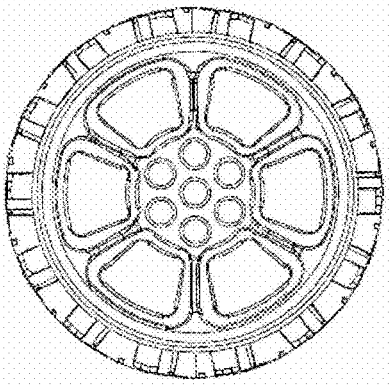
FIG. 34 depicts a perspective view, a side view, and a plan view of an example of a wheel in a toy construction set in accordance with an embodiment.
Figure 34:
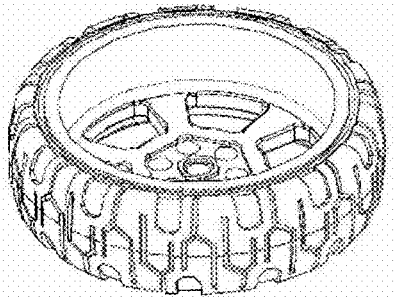
Figure 34:
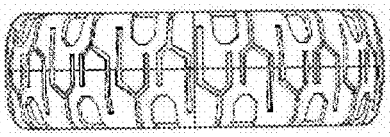
Figure 35:
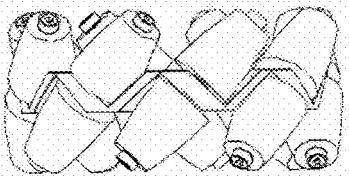
FIG. 35 depicts a perspective view, a side view, and a plan view of an example of a Mecanum wheel in a toy construction set in accordance with an embodiment.
Figure 35:
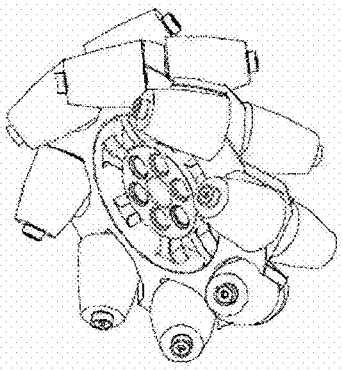
Figure 35:
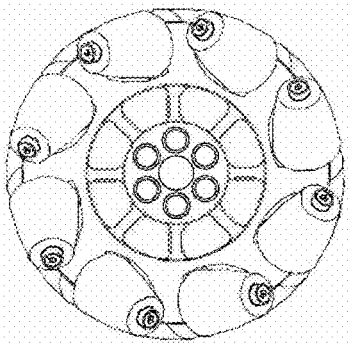

FIG. 34 depicts a perspective view, a side view, and a plan view of an example of a wheel 3400 in a toy construction set in accordance with an embodiment. FIG. 35 depicts a perspective view, a side view, and a plan view of an example of a Mecanum wheel 3500 in a toy construction set in accordance with an embodiment. Each of wheel 3400 and Mecanum wheel 3500 includes a plurality of through-holes arranged along a circle. The dimensions and shape of the through-holes follow the general rules of through-holes described above so that wheel 3400 and Mecanum wheel 3500 can be coupled to other construction elements and/or connectors by fastening elements, such as base pins, connection pins, and fasteners.

Figure 36:
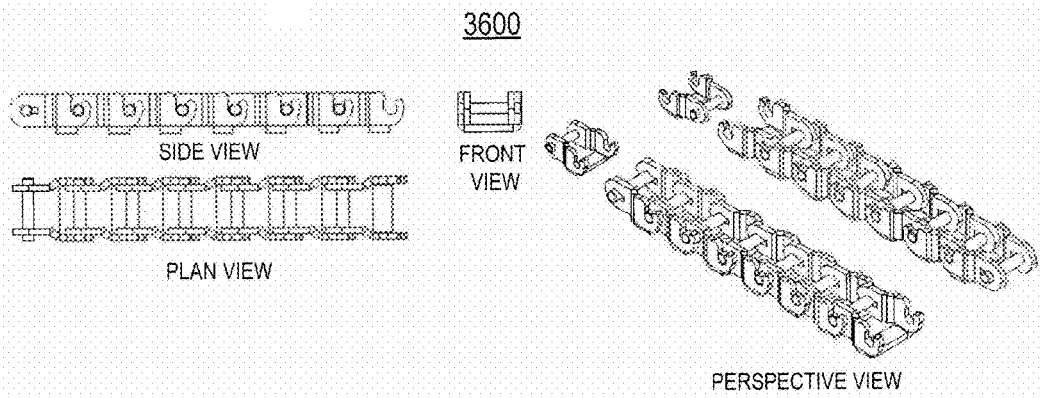
FIG. 36 depicts a perspective view, a side view, a front view, and a plan view of an example of a chain in a toy construction set in accordance with an embodiment.
Figure 37:
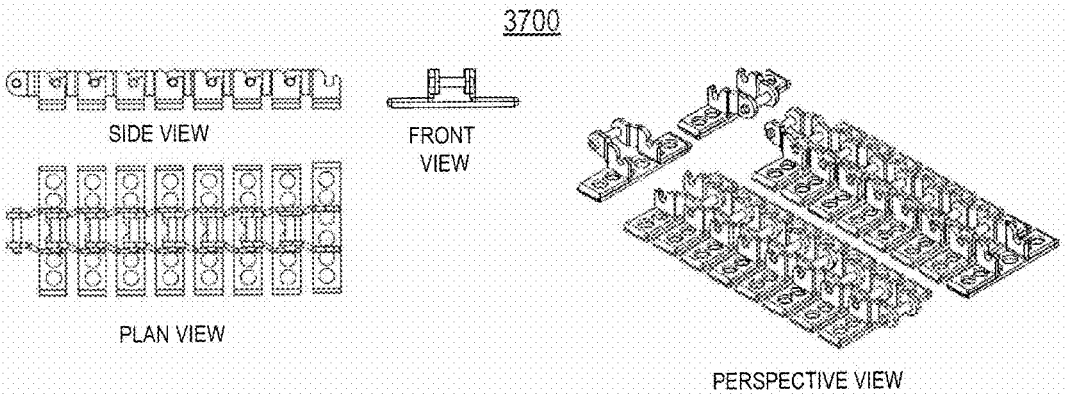
FIG. 37 depicts a perspective view, a side view, a front view, and a plan view of an example of a track in a toy construction set in accordance with an embodiment.

FIG. 36 depicts a perspective view, a side view, a front view, and a plan view of an example of a chain 3600 in a toy construction set in accordance with an embodiment. FIG. 37 depicts a perspective view, a side view, a front view, and a plan view of an example of a track 3700 in a toy construction set in accordance with an embodiment. Each of chain 3600 and track 3700 can be coupled to the gears, such as gear 2900, in the toy construction sets with different lengths (numbers of pieces).

It is to be appreciated that the Detailed Description section, and not the Summary and Abstract sections (if any), is intended to be used to interpret the claims. The Summary and Abstract sections (if any) may set forth one or more but not all exemplary embodiments of the present disclosure as contemplated by the inventor(s), and thus, are not intended to limit the present disclosure or the appended claims in any way.

While the present disclosure has been described herein with reference to exemplary embodiments for exemplary fields and applications, it should be understood that the present disclosure is not limited thereto. Other embodiments and modifications thereto are possible, and are within the scope and spirit of the present disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments may perform functional blocks, steps, operations, methods, etc. using orderings different than those described herein.

The breadth and scope of the present disclosure should not be limited by any of the above-described exemplary embodiments, but should be defined only in accordance with the following claims and their equivalents.

What is claimed is:

1. A toy construction set, comprising:

first and second construction elements, wherein (i) each of the first and second construction elements comprises two major surfaces, a plurality of through-holes, and two grooves, (ii) each of the two grooves is on a respective one of the two major surfaces along an axis of at least one of the through-holes, (iii) a thickness of each groove is substantially the same, and (iv) at at least one end of each groove, an edge of the groove is curved;

a pin comprising a body having a cavity and a member attached to one end of the body, wherein a first portion of an edge of the member is curved and a second portion of the edge of the member is straight, and a thickness of the member is not larger than the thickness of each groove; and a washer having a through-hole and an edge with a shape that matches a shape of the edge of the member of the pin, the washer configured to be disposed in a space formed between the first and second construction elements when the first and second construction elements are coupled so that the body of the pin passes through the through-hole in the washer, wherein a thickness of the washer is twice that of the thickness of each groove so as to constrain the first and second construction elements from rotating with respect to one another when the first and second construction elements are coupled by the pin and the fastener;

a fastener comprising a body and a head, wherein the pin and the fastener are configured to couple the first and second construction elements such that the body of the pin is configured to pass through an entirety of a first through-hole in the first construction element and at least a portion of a second through-hole in the second construction element and the body of the fastener is configured to insert into the cavity of the pin, and the member of the pin is fixed in place in one of the grooves of the first construction element when the first and second construction elements are coupled by the pin and the fastener so as to constrain the pin from rotating with respect to an axis of the body of the pin.

2. The toy construction set of claim 1, wherein each of the first and second construction elements, the pin, and the fastener comprises metal.

3. The toy construction set of claim 1, wherein each edge of the washer and the member of the pin is in a substantially "D" shape.

4. The toy construction set of claim 1, wherein when the first and second construction elements are coupled by the pin and the fastener, the body of the pin passes through the entirety of the first through-hole in the first construction element and a portion of the second through-hole in the second construction element so that the head of the fastener is not in contact with another end of the body of the pin so as to constrain the first and second construction elements from rotating with respect to one another.

5. The toy construction set of claim 1, wherein when the first and second construction elements are coupled by the pin and the fastener, the body of the pin passes though the entirety of the first through-hole in the first construction element and an entirety of the second through-hole in the second construction element so that the head of the fastener is in contact with another end of the body of the pin so as to allow the first and second construction elements to rotate with respect to one another.

6. The toy construction set of claim 5, wherein the body of the pin comprises a stepped groove at the another end of the body of the pin and that is adapted to receive a gasket.

7. The toy construction set of claim 1, further comprising a cross shaft, wherein at least one of the through-holes in the second construction element is a cross hole adapted to receive the cross shaft.

8. The toy construction set of claim 1, wherein a thickness of the head of the fastener is not larger than the thickness of each groove.

9. A toy construction set, comprising:

a connector comprising a first portion having a first through-hole and a second portion having a second through-hole, wherein an axis of the first through-hole in the first portion is perpendicular to an axis of the second through-hole in the second portion, and each of the first and second portions comprises two grooves on two major surfaces, respectively, of the respective portion of the connector along an axis of the first or second through-hole in the respective portion;

first and second pins, each comprising a body having a cavity and a member attached to one end of the body, wherein a thickness of the member is not larger than a thickness of each groove;

a washer having a through-hole and an edge with a shape matches a shape of the edge of the member of the first pin, the washer configured to be disposed in a space formed between the first construction element and the first portion of the connector when the first construction element and the connector are coupled so that the body of the first pin passes through the through-hole in the washer, wherein a thickness of the washer is twice that of the thickness of each groove so as to constrain the first construction element and the connector from rotating with respect to one another when the first construction element and the connector are coupled;

first and second fasteners, each comprising a body and a head; and first and second construction elements, each comprising a through-hole, wherein the first pin and the first fastener are configured to couple the connector and the first construction element such that the body of the first pin is configured to pass through at least a portion of the first through-hole in the first potion of the connector and at least a portion of the through-hole in the first construction element and the body of the first fastener is configured to insert into the cavity in the first pin, the second pin and the second fastener are configured to couple the connector and the second construction element such that the body of the second pin is configured to pass through at least a portion of the second through-hole in the second potion of the connector and at least a portion of the through-hole in the second construction element and the body of the second fastener is configured to insert into the cavity in the second pin, for each of the first and second portions of the connector, at at least one end of each groove, an edge of the groove is curved, for each of the first and second pins, a first portion of an edge of the respective member is curved and a second portion of the edge of the respective member is straight, and the first and second construction elements are coupled via the connector so that an axis of the through-hole in the first construction element is perpendicular to an axis of the through-hole in the second construction element.

10. The toy construction set of claim 9, further comprising:

a third pin comprising a body having a cavity and a member attached to one end of the body, wherein a thickness of the member is not larger than the thickness of each groove;

a third fastener comprising a body and ahead; and a third construction element comprising a through-hole, wherein the connector further comprises a third portion having a third through-hole, an axis of the third through-hole in the third portion is perpendicular to the each of the axes of the second and third through-holes in the second and third portions, respectively, and the third portion comprises two grooves on two major surfaces, respectively, along an axis of the third through-hole;

wherein the third pin and the third fastener are configured to couple the connector and the third construction element such that the body of the third pin is configured to pass through at least a portion of the third through-hole in the third portion of the connector and at least a portion of the through-hole in the third construction element and the body of the third fastener is configured to insert into the cavity in the third pin, and the first, second, and third construction elements are coupled via the connector so that the axes of the respective through-hole in each of the first, second, and third construction elements are perpendicular to one another.

11. The toy construction set of claim 9, wherein each of the connector, the first and second construction elements, the first and second pins, and the first and second fasteners comprises metal.

12. The toy construction set of claim 9, further comprising:

a cross shaft; and a third construction element comprising a cross hole, wherein the cross shaft is configured to couple the connector and the third construction element such that the cross shaft is configured to pass through the cross hole in the third construction element and another through-hole in the third portion of the connector.

13. The toy construction set of claim 9, wherein when the first and second construction elements are coupled via the connector, the member of the first pin is fixed in place in one of the grooves of the first portion of the connector, and the member of the second pin is fixed in place in one of the grooves of the second portion of the connector.

14. The toy construction set of claim 9, wherein each of the edges of the washer and the member of the pin is in a substantially "D" shape.

15. The toy construction set of claim 9, wherein at least one of the first and second construction elements comprises a plurality of round holes arranged in one or more straight lines.

16. The toy construction set of claim 9, wherein at least one of the first and second construction elements comprises a plurality of gear teeth along an edge of the construction element and a plurality of round holes arranged along a circle.

17. A toy construction set, comprising:

first and second construction elements, wherein (i) each of the first and second construction elements comprises two major surfaces, a plurality of through-holes, and two grooves, (ii) each of the two grooves is on a respective one of the two major surfaces along an axis of at least one of the through-holes, (iii) a thickness of each groove is substantially the same, and (iv) at at least one end of each groove, an edge of the groove is curved;

a base pin comprising a body having a cavity and a member attached to one end of the body, wherein a first portion of an edge of the member is curved and a second portion of the edge of the member is straight, and a thickness of the member is not larger than the thickness of each groove;

at least one connection pin, each comprising a body having a cavity and a bolt; and a fastener comprising a body and a head;

wherein the base pin, the at least one connection pin, and the fastener are configured to couple the first and second construction elements such that the body of the base pin is configured to pass through at least a portion of a first through-hole in the first construction element, the body of the fastener is configured to insert into the cavity of one of the at least one connection pin, and the bolt of one of the at least one connection pin is configured to insert into the cavity of the base pin, the member of the base pin is fixed in place in one of the grooves of the first construction element when the first and second construction elements are coupled by the base pin, the at least one connection pin, and the fastener so as to constrain the base pin from rotating with respect to an axis of the body of the base pin, and the first and second construction elements are spaced apart by the at least one connection pin.

18. The toy construction set of claim 17, wherein the at least one connection pin comprises a first connection pin and a second connection pin; and whet the first and second construction elements are coupled, the bolt of the first connection pin is inserted into the cavity of the second connection pin.

19. The toy construction set of claim 17, wherein each of the first and second construction elements, the base pin, the connection pin, and the fastener comprises metal.

20. The toy construction set of claim 17, further comprising a cross shaft, wherein at least one of the through-holes in the second construction element is a cross hole adapted to receive the cross shaft.

21. The toy construction set of claim 17, wherein a thickness of the head of the fastener is not larger than the thickness of each groove.

22. The toy construction set of claim 17, wherein the edge of the member of the base pin is in a substantially "D" shape.

* * * * *